US006076204A

United States Patent [19]

Mullick

[11] Patent Number: 6,076,204

[45] **Date of Patent: *Jun. 20, 2000**

[54] MODULAR BATHING UNIT

[75] Inventor: Abir Mullick, Buffalo, N.Y.

[73] Assignee: Research Foundation of State University of New York, Amherst, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/289,068

[22] Filed: Aug. 11, 1994

[51] Int. Cl.[7] ..... A47K 3/02

[52] U.S. Cl. ..... 4/556; 4/565.1; 4/579; 4/670; 4/584

[58] Field of Search ..... 4/555, 556, 572.1, 4/584, 663, 664, 670, 696, 562.1, 565.1, 576.1, 577.1, 579, 592, 595, 612, 614; 52/34, 35

[56] References Cited

U.S. PATENT DOCUMENTS

| | | | |
|---|---|---|---|
| 2,100,568 | 11/1937 | Norris | 4/584 X |
| 2,430,024 | 11/1947 | Morrison | 4/577.1 |
| 2,460,005 | 1/1949 | Gruen | 4/670 |
| 3,078,472 | 2/1963 | Turner | 4/562.1 |
| 3,193,848 | 7/1965 | Levy | 4/611 |
| 3,230,549 | 1/1966 | McMurtrie et al. | 52/35 X |
| 3,555,746 | 1/1971 | Geleziunas | 52/34 X |
| 3,568,220 | 3/1971 | Dees | 4/576.1 |
| 3,579,668 | 5/1971 | Aronovitz | 4/578.1 |
| 3,604,018 | 9/1971 | Moran | 4/556 |
| 3,875,597 | 4/1975 | McGaffin et al. | 4/578.1 |
| 4,360,159 | 11/1982 | Haynes | 239/282 |
| 4,360,935 | 11/1982 | Barrett, Sr. | 4/555 |
| 4,424,598 | 1/1984 | Cima | 4/524 |
| 4,457,031 | 7/1984 | Moore | 4/614 |
| 4,796,312 | 1/1989 | Corlew | 4/555 |
| 4,802,247 | 2/1989 | Leichle et al. | 4/556 |
| 4,881,281 | 11/1989 | Lavoine et al. | 4/572.1 |
| 4,928,329 | 5/1990 | Palmeri | 4/555 X |
| 4,987,619 | 1/1991 | Smith | 4/612 |
| 4,993,201 | 2/1991 | Buynard | 52/35 |
| 5,090,068 | 2/1992 | Zellner | 4/578.1 |
| 5,163,187 | 11/1992 | Dannenberg et al. | 4/556 |
| 5,220,696 | 6/1993 | Dannenberg et al. | 4/556 |
| 5,249,400 | 10/1993 | Turner | 52/34 X |
| 5,329,651 | 7/1994 | Mardero et al. | 4/562.1 X |
| 5,359,820 | 11/1994 | McKay | 4/696 |

FOREIGN PATENT DOCUMENTS

| | | | |
|---|---|---|---|
| 0088736 | 9/1983 | European Pat. Off. | 4/670 |
| 3511267 | 10/1986 | Germany | 4/562.1 |

*Primary Examiner*—Robert M. Fetsuga
*Attorney, Agent, or Firm*—Schwegman, Lundberg, Woessner & Kluth, P.A.

[57] ABSTRACT

A frame is provided having receptacles disposed thereon for receiving a variety of interchangeable bathing equipment panels which may be custom-installed on the frame to the needs and preferences of the unit's intended users. A conduit housing a water line, a control line, and an electrical line is mounted on the frame's outer surface. The conduit includes means for interfacing water, control, and electricity lines of the conduit with those of equipment panels requiring water, control, or electricity for operation. The frame may further have installed thereon a tub comprising rear, side, front, and door panels, the rear and side panels being mounted to receptacles at the tub region of said frame. In one embodiment, the tub includes a door that is pivotable between a first open position, a first closed position defining a full-sized bathtub, a second open position, and a second closed position defining a half-size bathtub.

38 Claims, 31 Drawing Sheets

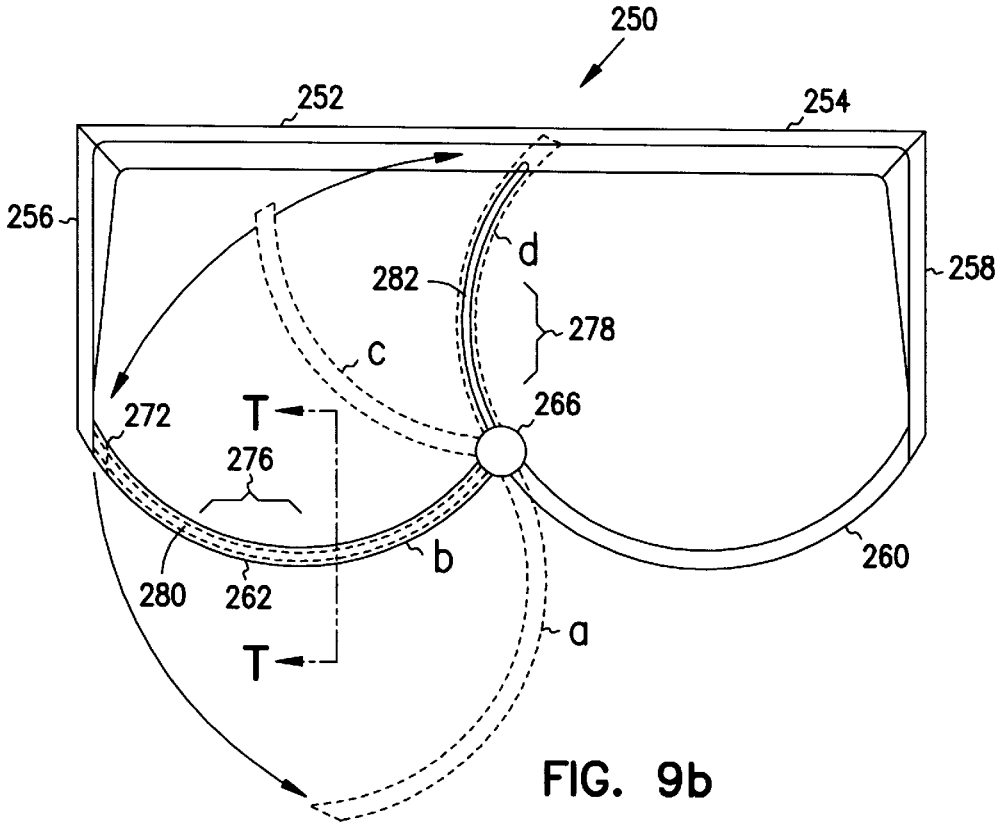
FIG. 9b
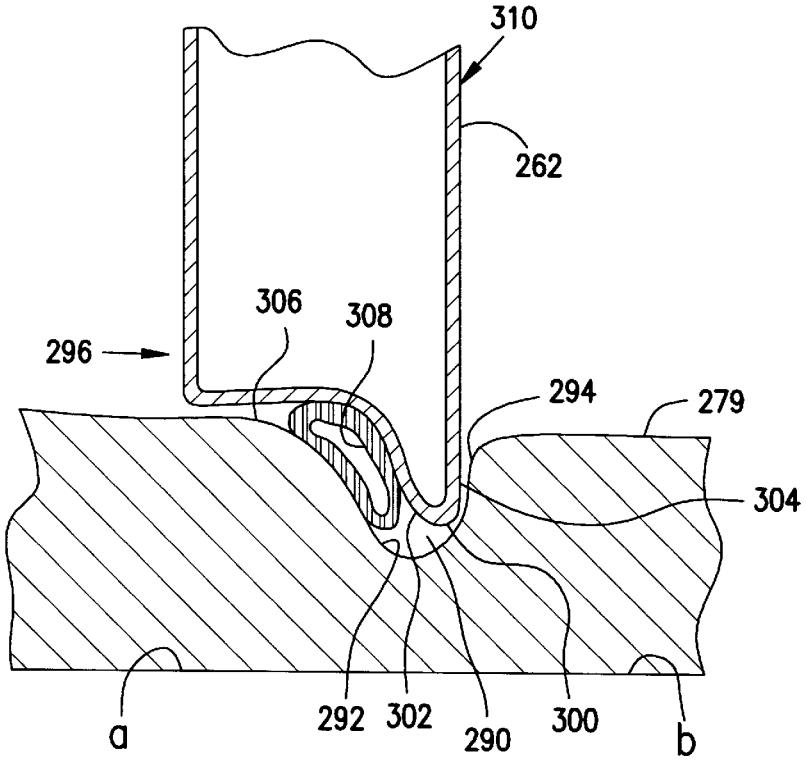
FIG. 9c (Priot Art)

MODULAR BATHING UNIT

FIELD OF THE INVENTION

This invention relates generally to bathtub/shower bathing units. More particularly, the invention relates to a bathing unit which may be customized to meet the preferences and needs of the unit's intended users. Insofar as the bathing unit may be customized to the requirements of users having needs broad in scope, the invention inherently and further relates to a bathing unit which may be configured for use by specialized classifications of users including: (1) persons having limited locomotive ability, (2) aged persons, and (3) persons requiring assistance in bathing. The invention still further relates to a bathing unit comprising preplumbed and prewired interfitting parts designed for simplified installation and simplified post-installation modification of the unit.

BACKGROUND OF THE INVENTION

Characterized by a one-piece metal or ceramic tub, a shower head of fixed height, ceramic tiles affixed directly to the walls above the tub, and typically a soap dish protruding from one of its walls, the standard bathing unit found in most homes exhibits numerous limitations.

Perhaps the most significant limitation of the standard tub is that its design is inflexible. Particularly, the design of the standard unit fails to account for the fact that bathing preferences (including aesthetic tastes) and needs vary greatly among bathers depending on locomotive ability, age, size, cognitive ability, independence, tastes, and many other factors. The standard unit also fails to account for the fact that primary users of the unit will change over time, for example when home ownership is transferred. The standard unit still further fails to account for the fact that preferences (including aesthetic tastes) and needs of users will change over time. As a result of these failures, embodiments of the standard unit cannot be modified efficiently without introduction of complex procedures. Often, modifying the standard bathing unit involves the costly process of destroying and rebuilding an entire bathing unit wall, or, alternatively, precariously mounting a specialized adaptation which dangerously crowds the bathing area.

Many problems with the standard bathing unit are problems encountered subjectively by persons falling within a specialized classification of users. For example, persons having limited locomotive ability have difficulty in surmounting the tub wall of the standard unit upon ingress or egress, and generally have difficulty maintaining their balance within and in moving about the standard tub. They further encounter difficulty in moving between a seated and standing position within a standard bathing unit. Finally, since they are more susceptible to falling, persons having limited locomotive ability are especially prone to injury resulting from bodily contact with blunt objects rigidly protruding from the wall of a standard unit, including soap dishes and water faucets.

Aged persons, who often also fall into the classification of users having limited locomotive ability, find that the lighting of the standard bathing unit does not suit their needs. For the aged, available bathing units either are too dimly lit, to the extent that articles or equipment are insufficiently illuminated, or else the standard units have excessive overhead lighting, which reportedly creates for aged persons an emotionally stressful environment.

The standard unit is unsuitable for persons requiring assistance in bathing as well. Specifically, the standard unit includes no features or adaptations designed for the benefit of caregivers to bathers needing assistance. Consequently, caregivers have limited access to persons requiring assistance, and their lack of support, comfort, and mobility about and within a standard tub undermines the quality of care they are able to provide.

Efforts to address these and other limitations and problems in the past have been narrow in scope. Prior art references that teach improvements in bathtub/shower bathing units have for the most part concerned only slight modifications of the standard bathing unit design and have generally addressed only a single adaptation or feature of bathing units.

A number of prior art references related to improved bathing units, for example, teach improved means for ingress to and egress from a bathtub by persons having limited locomotive ability. U.S. Pat. No. 5,163,187 teaches an inwardly-opening bathtub door having an inflatable seal inflated and deflated as required based on the output of water-level sensors. U.S. Pat. No. 4,360,935 teaches an inwardly-opening bathtub door that engages a stopping surface of a tub opening such that pressure on a resilient but non-inflatable seal interposed between the door and the wall is increased as the tub is filled. U.S. Pat. No. 4,802,247 meanwhile, teaches an outwardly-opening tub door having a lip that engages a recess formed in a tub opening. The door further has lifting means for engaging and disengaging the lip with the recess. A much different approach to improving ingress and egress to and from a tub is proposed in U.S. Pat. No. 3,604,018. There, a bathtub is disclosed having a circular door that is rotatable from a first position providing an entrance and a second position defining an enlarged sealed bathtub.

Other prior art references related to bathing units teach various bathtub seats and lift mechanisms. U.S. Pat. Nos. 3,889,304 and 3,381,317 disclose bathtub seats which are pivotable from a position outside a tub to a position inside, and which may be lowered to a position beneath the tub's water level. U.S. Pat. Nos. 5,090,068 and 3,875,597 teach of bath seats which may be firmly positioned on a bathtub but which may be removed when desired. U.S. Pat. No. 3,579,668 describes a bath seat fixedly attached to a bathtub wall which may be folded out of the way of a bather when necessary.

Still other references teach improved shower means. U.S. Pat. No. 3,579,668, for example, teaches a hand shower having a digital display for displaying water temperature. Meanwhile, U.S. Pat. No. 4,360,159 discloses an adjustable shower head including means for manual adjustment of the height of said shower head.

References describing complete bathing units teach of structures which may be transported in a disassembled condition and assembled at the location of installation. For example, U.S. Pat. No. 4,993,201 discloses a pre-cast shower stall assembly comprising a plurality of interconnecting and interfitting parts, including means for sealing those parts and means for firmly fixing the shower into a wall space. Similarly, U.S. Pat. No. 4,987,619 describes a bathtub/shower bathing unit having a plurality of interfitting parts, the unit being designed such that certain parts thereof are attachable directly to the interior wall studs of a building. References that describe bathing units comprising multiple interfitting parts teach that the benefit of such modularity is that the modular design simplifies installation of such bathing units. The references do not teach or suggest, however, that flexibility, functionality, or maintainability of bathing units may benefit from a modular multi-part design.

As mentioned, prior art references related to bathing units tend to concentrate on a single feature or adaptation of the standard unit. The approach of the present invention runs counter to that of the prior art in that it approaches problems associated with bathing holistically. The present invention sets forth to provide a bathing unit which can be adapted to resolve the multitude of problems outlined above.

More particularly, it is a principal object of the present invention to provide a frame for receiving bathing equipment panels, the panels being custom-installed on the frame in accordance with the preferences and needs of its intended primary users.

Insofar as the bathing unit is customizable to meet a broad range of specialized needs, it is an inherent and further objective of the invention to provide a bathing unit which is configurable to meet the needs of specialized classifications of users including persons having limited locomotive ability, aged persons, and persons requiring assistance in bathing.

It is a further object of the invention to provide a bathing unit comprising multiple interfitting, preplumbed and prewired parts designed as such to simplify the unit's installation.

It is a still further object of the invention to provide a bathing unit whose features can be easily modified as its users, or the needs or preferences of its users change.

It is yet another object of the present invention to provide a bathing unit which can be adapted to aesthetic tastes of its users, and which can be subsequently modified aesthetically as its users or the tastes of its users change.

These and other objects, features, and advantages of the present invention will become clear in the ensuing detailed description.

SUMMARY OF THE INVENTION

The heart of the present invention is a frame having receptacles disposed thereon for receiving a variety of interchangeable equipment panels which may be custom-installed on the frame to the needs and preferences of the unit's intended users.

Equipment panels which may be mounted on the frame include grab bar panels; a control and display panel; a shower head panel; a water faucet panel; storage rack panels; a towel rack panel; heater panels; ventilation panels; lighting panels and decorative panels. The features of the panels are typically recessed and clearly labeled for safety and ease of use.

A conduit housing a water line, a control line, and an electrical line is mounted on the frame's outer surface. The conduit includes means for interfacing water, control, and electricity lines of the conduit with those of equipment panels as required.

The bathing unit may further have a tub comprising rear, side, front, and door panels, the rear and side panels being mounted to receptacles at the tub region of said bathing unit frame. In one embodiment, the tub includes a door that is pivotable between a first open position, a first closed position defining a full-sized bathtub, a second open position, and a second closed position defining a half-size bathtub.

Panels of the tub may have mounted thereon faucets or seats for bathers and/or their caregivers. The seats may be fixed, removable, collapsible, or liftable.

BRIEF DESCRIPTION OF THE DRAWINGS

In the accompanying drawings, like numerals are used to designate the same elements throughout the views.

FIG. 9*b* is a top view of a modular bathtub having a four-position door.

FIG. 9*c* is a cross-sectional view according to section line T—T of FIG. 9*b* illustrating a sealing means for a modular bathtub door.

DETAILED DESCRIPTION OF THE PREFERRED EMBODIMENT(S)

Figure 1:
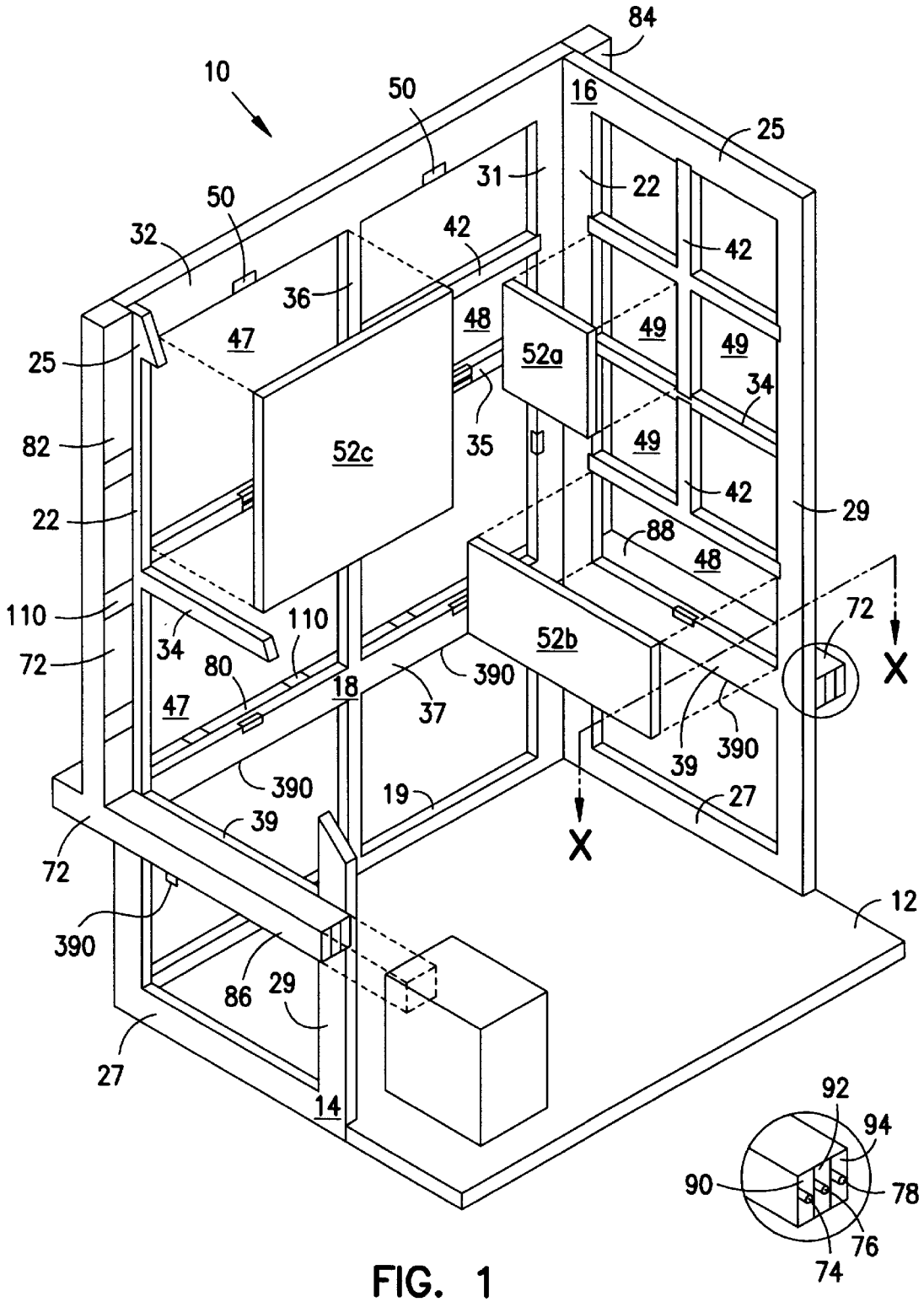
FIG. 1 is a perspective view of the frame of the bathing unit, including a view of the conduit mounted on the frame's outer surface.

Referring to FIG. 1, the heart of the present invention is the frame 10. In the preferred embodiment, the frame comprises a floor 12, a pair of sidewalls 14 and 16, and a rear wall 18. As shown, each of the sidewalls is delimited by a side corner frame member 22, a top side frame member 25, a bottom side frame member 27, and a front frame member 29. Rear wall 18, meanwhile, is delimited by bottom rear frame member 19, rear corner frame members 31, and a top rear frame member 32. Further supporting the frame are side middle frame members 34, rear middle frame member 35, rear longitudinal frame member 36, rear tub-level frame member 37, and side tub-level frame members, 39. Frame 10 may be made of any rigid material. Most preferably, frame 10 is corrosion-resistant and and is made of fiberglass, pvc, or aluminum.

Continuing with reference to FIG. 1, frame 10 further includes lattice members 42 of various types, which are fittible into the frame members of the rear wall or the sidewalls. Defined by frame 10 are eight large receptacles 47. In the preferred embodiment, there are two such large receptacles on each sidewall, and four on the rear wall, as shown. Lattice members 42 may be installed within these large receptacles to form smaller receptacles of various orientations. TYPE A lattice members 42 are cross-shaped and, when fitted into a large receptacle, define four small receptacles 49. When fitted into a large receptacle, T-shaped TYPE B lattice members 42 define two small receptacles 49, and a rectangular medium receptacle 48. A straight bar TYPE C lattice member 42, meanwhile, defines two medium receptacles. It is seen that the orientation of receptacles can be changed by changing the orientation of the lattice members. For example, if the TYPE C lattice member depicted in FIG. 1 is reoriented 90 degrees, medium receptacles 48 will be arranged vertically on the rear wall, and not horizontally.

Lattice members 42 are installed in notches 50 formed in the frame. Generally, screws are driven through axially-aligned holes of the lattice members and the notches to compress a sealing gasket (not shown) interposed between the notches and the lattice members. When notches do not receive lattice members, they may receive removable rubber spacers (not shown) which prevent the intrusion of moisture into the frame's interior through unused notches. Preferably, however, plates 58 of bathing equipment panels 52 (see FIG. 2*a*), have a greater width than that defined by oppositely-arranged notches 50, and spacers are not necessary.

Receptacles 47, 48, 49, are formed to receive modular bathing equipment panels 52 of various sizes. Panels received within the frame's wall receptacles may contain therein or have mounted thereon various equipment for use in bathing including controls, displays, shower heads, water faucets, storage racks, towel racks, heaters, ventilation means, and lights. There further may be provided "decorative panels" which have as their only "equipment" a flat, finished outer surface. Preferably comprised of molded fiberglass or acyrilic, the panels may be of any texture, color, or pattern.

The panels are interchangeable so that the assembly may be customized to fit the specialized needs of each intended user. Small panels 52*a* are fittible into a small receptacle 49, medium-size panels 52*b* with are fittible into a medium receptacle 48, while large panels 52*c* are fittible into a large receptacle, 47.

Figure 2A:
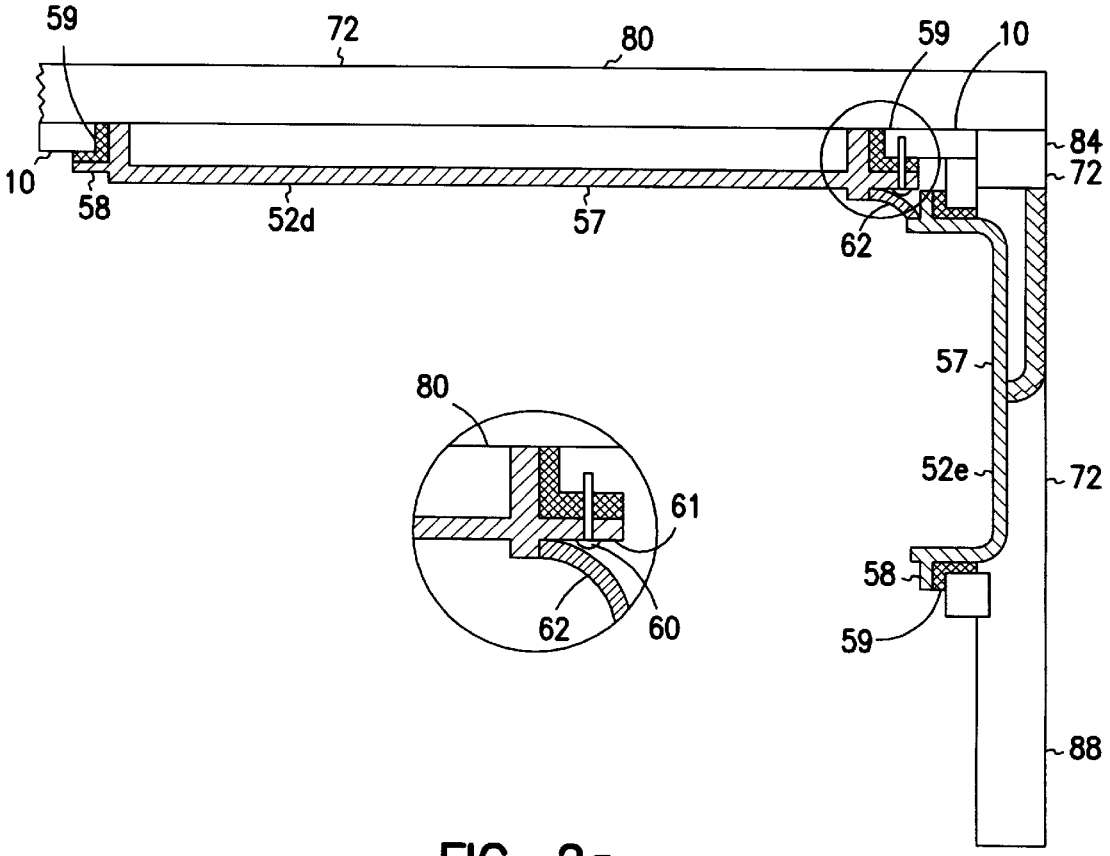
FIG. 2*a* is a cross-sectional view according to section line X—X in FIG. 1. showing installed modular bathing equipment panels.

FIG. 2*a* is a top view of a pair of representative panels 52 as installed on frame 10. Panels 52 comprise a body 57 contiguous with a plate 58. The edges of plate 58 extend beyond the edges of the body 57. When installed, sealing gasket 59 is interposed between frame 10 and plate 58. It is seen that panel body 57 rests within a frame receptacle, while plate 58 limits the depth of penetration of panel 54 into said receptacle. For securing of panel 52 to frame 10, screws 60, preferably comprising non-corrosive material, are driven through preformed and aligned holes of the plate 58, the gasket 59, and the frame 10. Seal washers 61 interposed between heads of the screws 60 and plate 58, prevent intrusion of moisture through said holes into the interior of frame 10. By tightening screws 60, gasket 59 is compressed and the sealing action between panel 52 and frame 10 is increased. After screws 60 are tightened, elongated decorative strips 62 are press-fit between panels such that screw heads 60 are hidden from view. It is seen that first panel 52*d* is a non-recessed large panel or a non-recessed horizontally-mounted medium panel. Second panel 52*e* is a recessed small panel or a recessed vertically-mounted medium panel.

Depending on type and application, the assembly's panels may require a water source, communication means, or electrical power for operation. Returning to FIG. 1, water, communication means, and electricity are provided to panel-mounted bathing equipment preferably by way of a conduit 72, which houses a water line 74, a control line 76, and an electricity line 78. In the preferred embodiment, conduit 72 is mounted on the frame's outer surface as shown and contains three main branches. A rear conduit section 80 is attached to and extends along the rear wall's tub-level frame member 37, and two corner conduit sections, 82 and 84, extend along each frame corner. Preferably made of PVC, fiberglass or other polymers, conduit 72 further includes feeder sections 86 and 88, which are attached to and extend along the frame's tub-level side frame members 39. Arranged on conduit 72 are a plurality of access nodes 110. Access nodes 110 provide means for interfacing water, control, and electricity lines of conduit 72 with those of equipment panels as required.

Figure 2B:
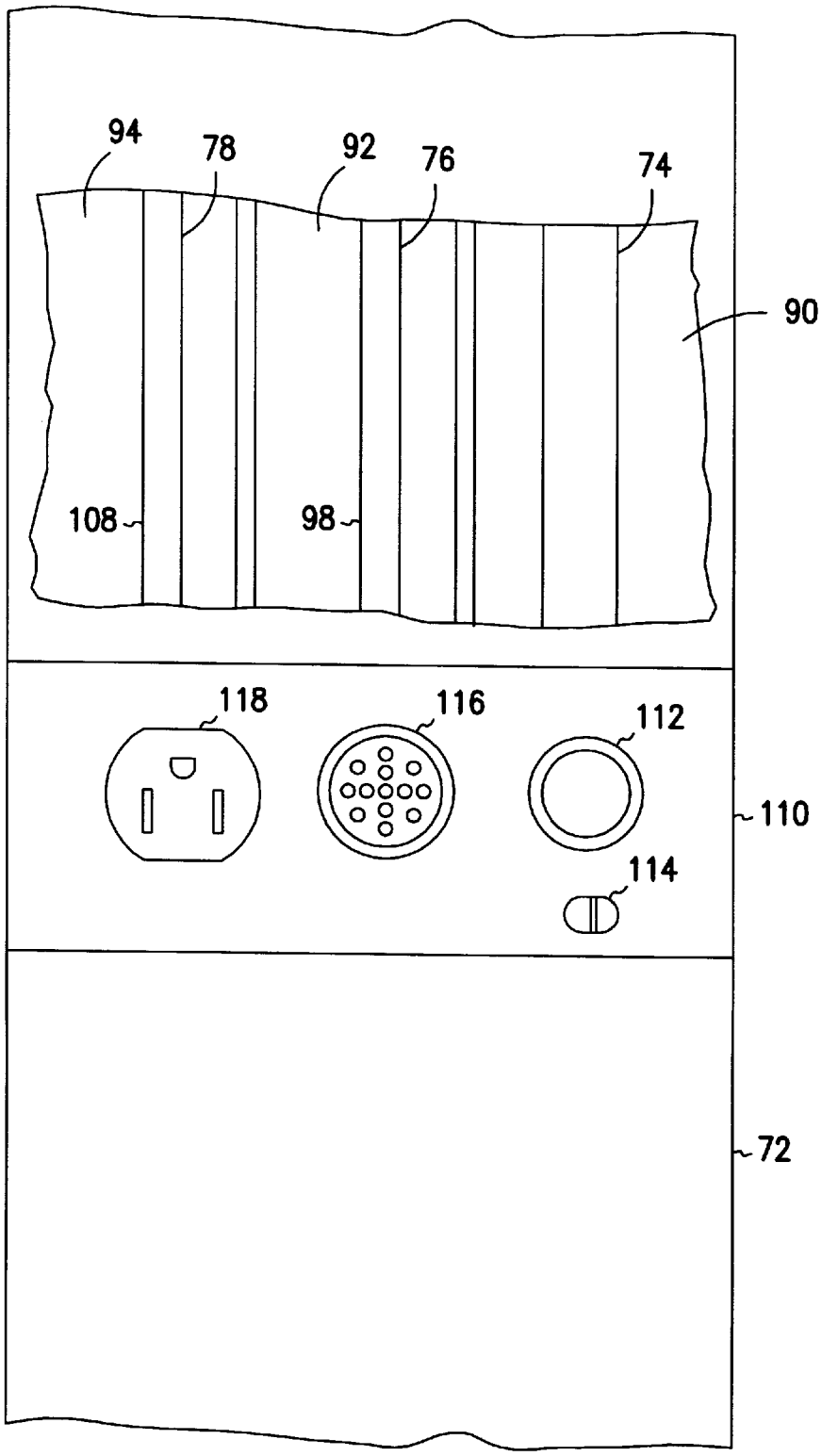
FIG. 2*b* is a cut away front view of an access node in a conduit.

As shown in FIG. 2*b*, all sections of conduit 72 comprise three channels 90, 92, and 94 for receiving, respectively, the water line 74, the control line 76, and the electricity line 78. Typically, each channel is filled with pipe or electrical insulation, as is necessary.

Water line 74 preferably comprises a single water pipe, but alternatively may comprise a pair of pipes, one pipe for hot water and the other for cold as in a conventional bathing unit. It is seen that the single water pipe design contemplates a system whereby water in the line 74 is turned from cold to hot based on demand. Specifically, a coil heater (typically wrapped around a section of pipe) is provided a short distance away from the location of installation which heats water in a feeder pipe interfaced with the conduit's water line network. The water heater is controlled by communication means, provided by control line 76, between the faucet and the heater.

It is known that the single water pipe design is more energy efficient than a two water pipe design. Further, a single water pipe design minimizes the size of conduit 72 and minimizes the amount of pipe insulation required for insulating water line 74.

Still referring to FIG. 2*b*, control line 76 comprises a bundle of about 20 to 40 control wires (not shown) disposed within an insulating cover 98. Control line 76 carries low voltage DC electrical signals to and from various panels mounted on frame 10. For example, a transducer-generated signal from a faucet panel that indicates water flow rate may be provided which carries a signal for conversion and display to a control and display panel. Other control signals will be generated at a control and display panel which open and close relay contacts for starting and stopping motors, lights, or heaters at various locations of the frame. Every required control signal will have designated one control wire for transporting that signal and preferably no control wire will be designated to transport more than one signal.

Electricity line 78 comprises three wires: two terminal wires and a ground wire, all being disposed within insulating cover 108.

In addition to illustrating the internal components of conduit 72, FIG. 2*b* shows a representative access node 110. As indicated in FIG. 1, access nodes are disposed at approximately equal distances from one another along the conduit's corner sections, 82 and 84, and along the conduit's middle section 80. Access nodes 110 provide means for interfacing the conduit's water, control, and electricity lines with those of modular equipment panels on the side and rear walls. Feeder conduit sections 86 and 88 comprise no access nodes (except pipe nodes 390, see description accompanying FIG. 12). Primarily, feeder conduit sections 86 and 88 improve access to conduit 72, thereby simplifying the process of interfacing water and electrical lines 74 and 78 with the water and electrical systems of the building in which the bathing unit is installed.

Each access node 110 comprises an access water pipe 112 protruding from the surface of the node, and a knob 114 for manually opening and closing the access pipe 112. Representative access node 110 further comprises a female plug 116, which includes a plurality of pin holes, as shown, having electrical contacts, there being one contact for each control wire. Access node 110 still further has a female electrical outlet 118.

Each access node includes three taps which are installed within conduit 72 below the access node's surface. A water tap is provided by a T-type pipe connector interposed between straight sections of the conduit's water pipe. Each T-type pipe connector has a stem for receiving access pipe 112 which protrudes from each access node 110. Access pipe 112 includes means whereby the water flow in access pipe 112 is turned on or off by rotating knob 114. Knob 114 may be mounted directly to the exposed portion of access pipe 112. In the embodiment shown in FIG. 2*b*, Knob protrudes perpendicularly from the surface of access node 110, and is embodied by a slotted screw head. In such an embodiment, access pipe 112 should be bent or otherwise formed to include a section that lies parallel with the surface of the access node 112 within conduit 72 so that perpendicular mounting of knob 114 is accommodated.

A control line tap is provided by a one-input to two-output plug adaptor. It is observed, then, that control line 76 comprises several small control line sections interposed between control line taps of access node 110. Ends of the small control line sections terminate in plugs for engaging plugs of the adaptor.

An electrical tap is provided by a standard one-outlet electrical receptacle having exposed outlet 118. The terminal wires of small sections of electrical line 78 are electrically connected to each electrical receptacle and each electrical receptacle is properly grounded.

As mentioned, the interchangeable panels used in the present invention will vary in type and function. Now referring to FIGS. 3 through 8, features of several possible bathing equipment panels which may be installed on the frame of the present invention will be described in detail.

Figure 3A:
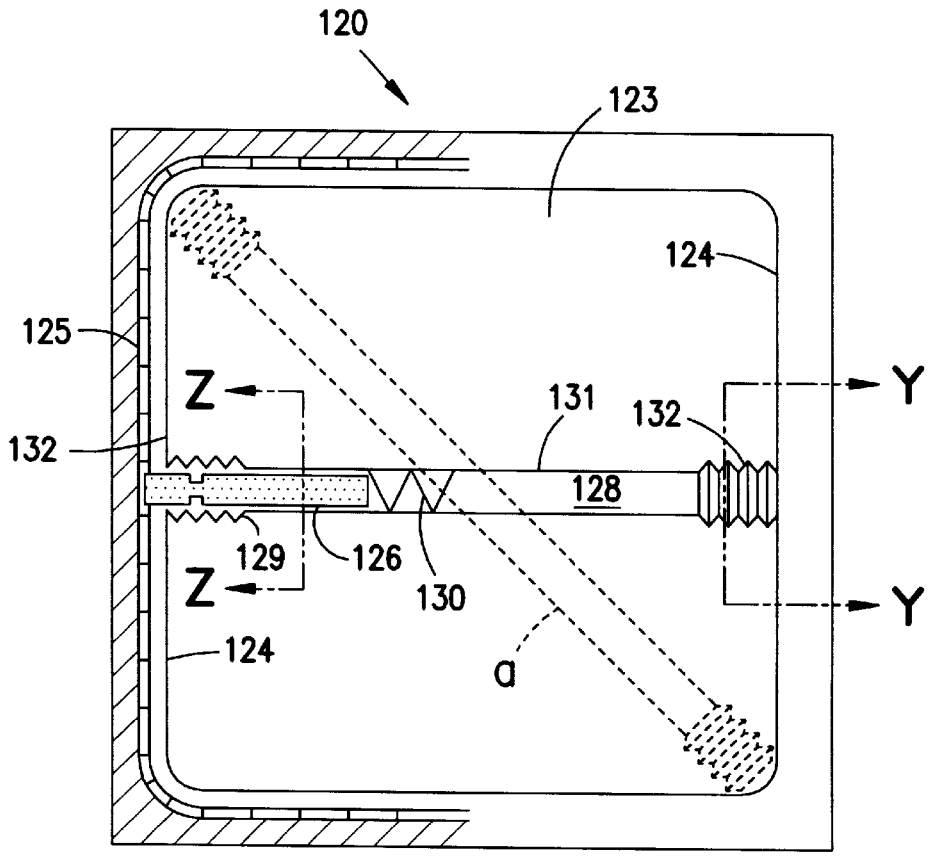
FIG. 3*a* is a front view of an embodiment of a grab bar panel mountable on the frame.

FIG. 3*a* shows an embodiment of a grab bar panel 120, typically fitted into a small receptacle. Within grab bar panel 120 is a recess defined by a rectangular rear wall 123 and peripheral wall 124. A track 125 is formed within peripheral wall 124 for receiving pins 126 of a grab bar 128. Grab bar 128 may be positioned and repositioned within its track 125 to multiple orientations, including diagonal orientations, as illustrated by dotted position line a. It is seen that grab bar 128 must extend to a greater distance when oriented diagonally than when oriented horizontally or vertically. Accordingly, grab bar 128 includes springs 130, received in its main body 131, for biasing pins 126 outwardly to a greater distance when grab bar 128 is moved from a horizontal or vertical orientation to a diagonal orientation. Grab bar 128 further includes a housing 129 which houses its main body 131, its springs 130 and pins 126. Housing 129 includes accordion ends 132 for allowing expansion of the grab bar.

Track 125 must exert enough force on grab bar 128 to hold grab bar 128 in a stable position while encountering forces imposed by a user during ordinary use, but not so much force that a user cannot adjust the orientation of grab bar 128 by sliding it within its track 125.

Figure 3B:
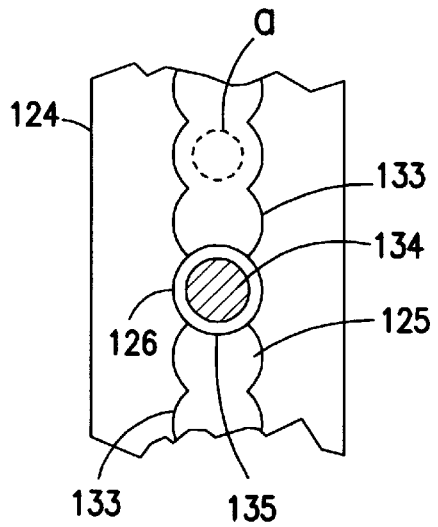
FIG. 3*b* is a cross-sectional view according to section line Y—Y in FIG. 3*a*.

FIG. 3*b* illustrates a first means for realizing this requirement. As shown, track 125 includes a series of grooves 133 for holding pins 126 (housed within housing 129) of grab bar 128. In this embodiment, pins 126 should have a rigid core 134 surrounded by a soft, resilient outer sheath 135. In an engaged position, outer sheath 135 of pins 126 are in an expanded configuration and cause housing 129 to contact the walls of the grooves 133 in which grab bar 128 is engaged. When grab bar 128 is being moved, outer sheath 135 of pins 126 assume a compressed position (as illustrated by dotted position line a) to allow movement of grab bar 128 between grooves.

Figure 3E:
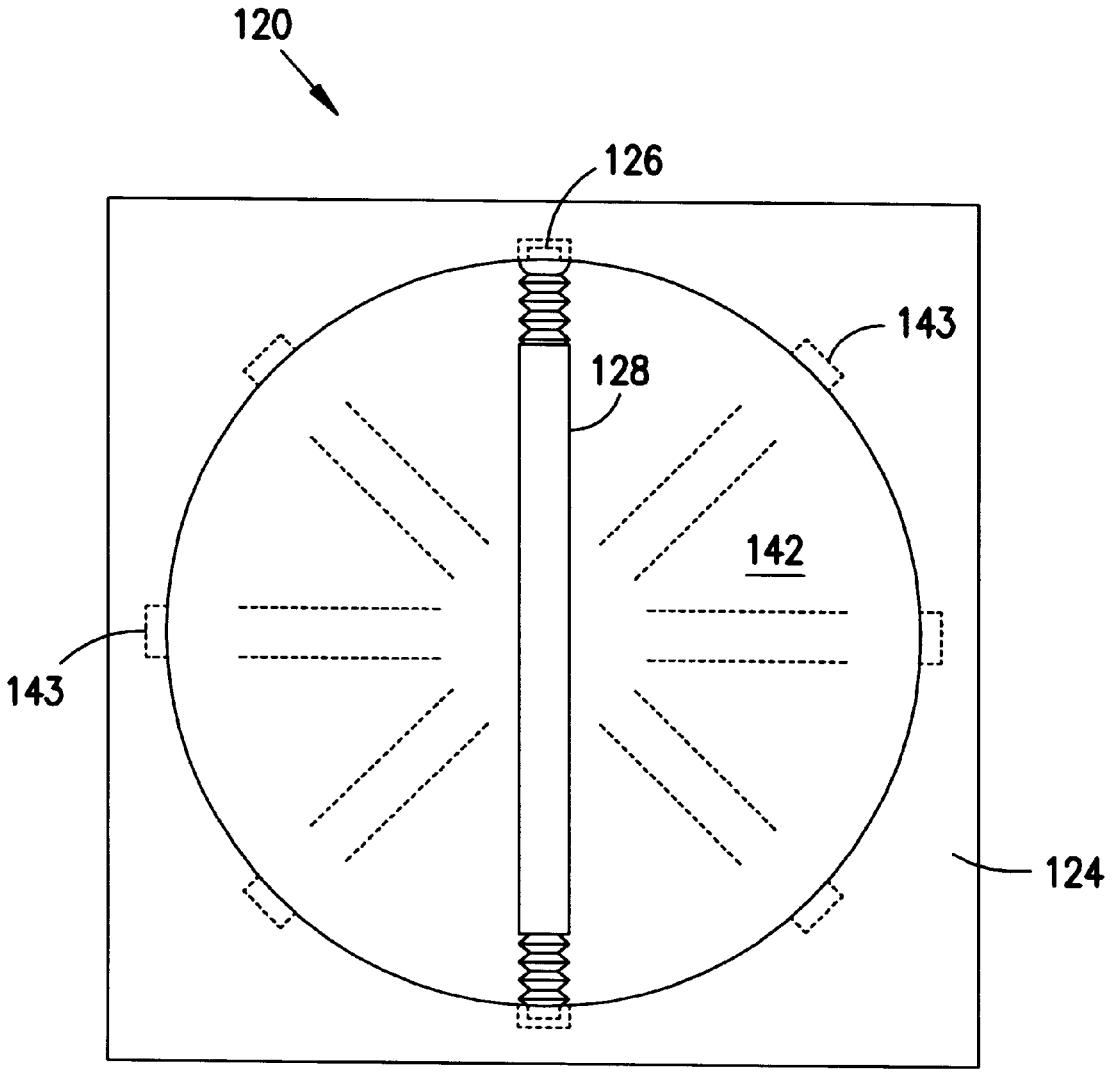
FIG. 3*e* is a front view of an alternative embodiment of a grab bar panel.

There are several alternative embodiments of the grab bar panel 120. For example, FIG. 3*e* shows a grab bar panel having a circular recess 142 replacing the rectangular recess of the embodiment described above. If a grab bar panel having a circular recess is implemented, grab bar pins 126 and springs do not have to be designed to enable grab bar 128 to extend to multiple distances, since the required grab bar extension distance will be the same regardless the angle at which the grab bar 128 is installed. Pins 126 must merely be resilient enough such that grab bar 128 is compressible from a length slightly larger than the diameter of the recess 142 to a length slightly smaller than the diameter of the recess 142 to enable installation of grab bar into the walls 124, of recess 142.

The embodiment of FIG. 3*e* further has a track of holes 143 replacing the track 125 of the embodiment of FIG. 3*a*. Each hole 143 is oppositely arranged with a complementary hole at the opposite end of the wall 124, and is formed to receive a grab bar pin 126. It is seen that grab bar 128 is fixed in position as soon as it is received within a pair of oppositely arranged holes 143, and does not have to be twisted for engagement and fixing of its orientation. Accordingly, the cross section of the wall-side of pins 126 do not have to be elliptical, but rather may be of any shape as long as pins 126 are received by holes 143 of the recess.

Features of the various embodiments of the grab bar panel thusfar described can be combined in further embodiments. It is seen, for purposes of illustration, that an embodiment of a grab bar panel having a circular recess and a grooved track is within the scope of the invention as well as an embodiment having a rectangular recess and a track comprising a plurality of oppositely arranged holes.

Figure 4A:
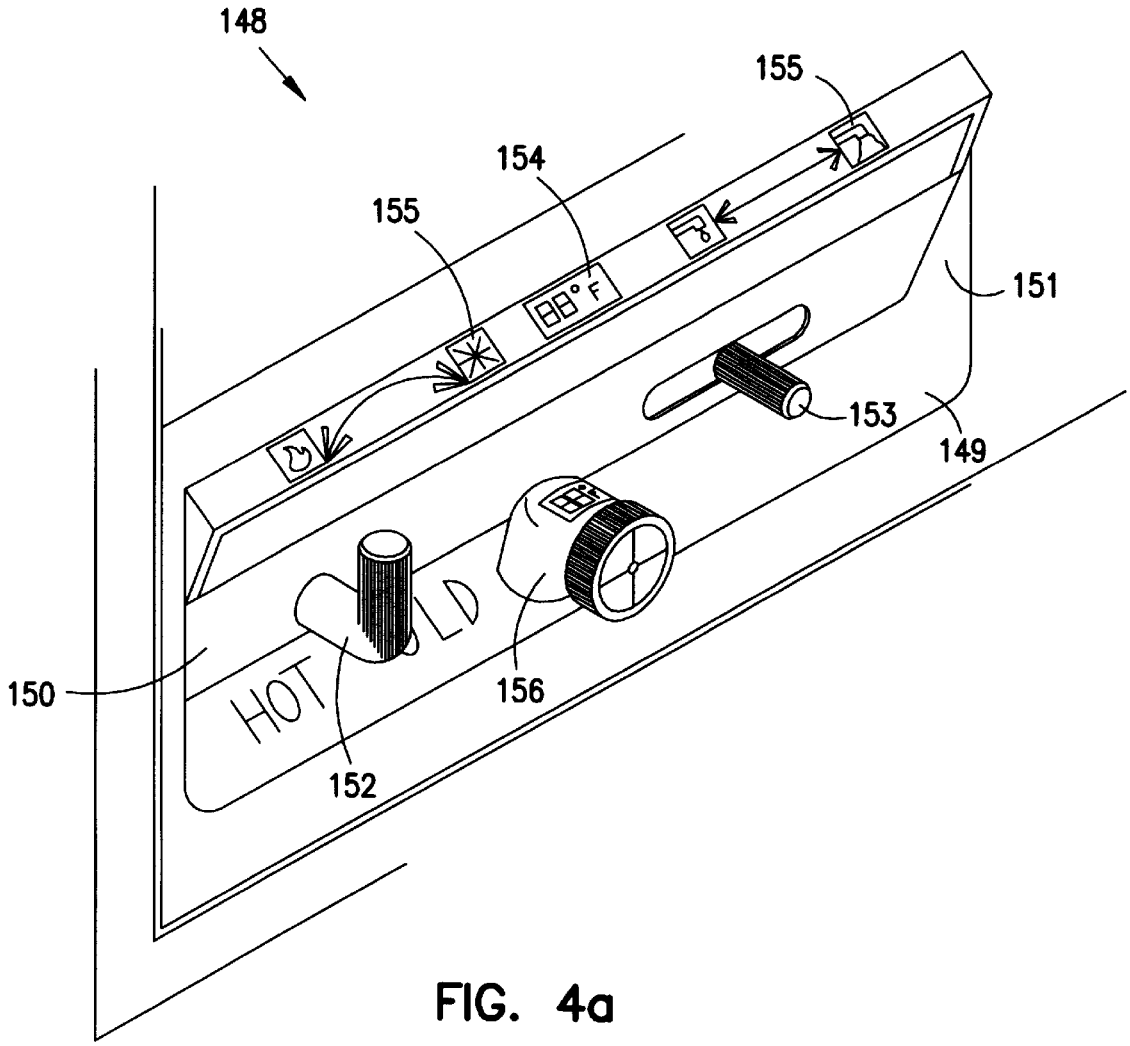
FIG. 4*a* is a perspective view of an embodiment of a control and display panel.

FIG. 4*a* shows a perspective view of a control and display panel 148 fittible into a horizontally oriented medium receptacle. Included in the panel is a recess defined by floor 149, rear wall 150, and sidewalls 151. Control and display panel 148 further has controls 152 and 153, and a display 154. The panel 148 may further house a hand-held shower 156. In the embodiment shown in FIG. 4*a*, control and display panel 148 is configured to control operation of hand-held shower 156, or may be adapted to control another single article of equipment disposed on that panel (a fixed shower, a water faucet, a heater). If panel 148 is configured to control a hand-held shower, two transducers will be included within the shower: a water flow sensor and a water temperature sensor. The outputs from these sensors are converted and displayed by display 154. Controls 152 and 153 adjust water temperature and water flow rate respectively. Specifically, a water heater, and second control 153 opens and closes an automatic valve included within hand-held shower 156. Water heater controls produce a DC signal proportional to the desired intensity of water heat. This signal will be communicated to the water heater by means of a designated control wire of control line 76. Alternatively, control 152 may select a preset temperature. Based on an input from the water temperature sensors, control signals may be generated to heat the water until the desired temperature is reached, and to maintain the water temperature at that pre-set level, as in a thermostat. It is seen that the form and operability of controls 152 and 153 have been designed to be different in order to minimize the chances of mistaking water temperature control for water flow control. Further, graphical symbols 155 have been provided for easy comprehension of the controls' functions.

Figure 4B:
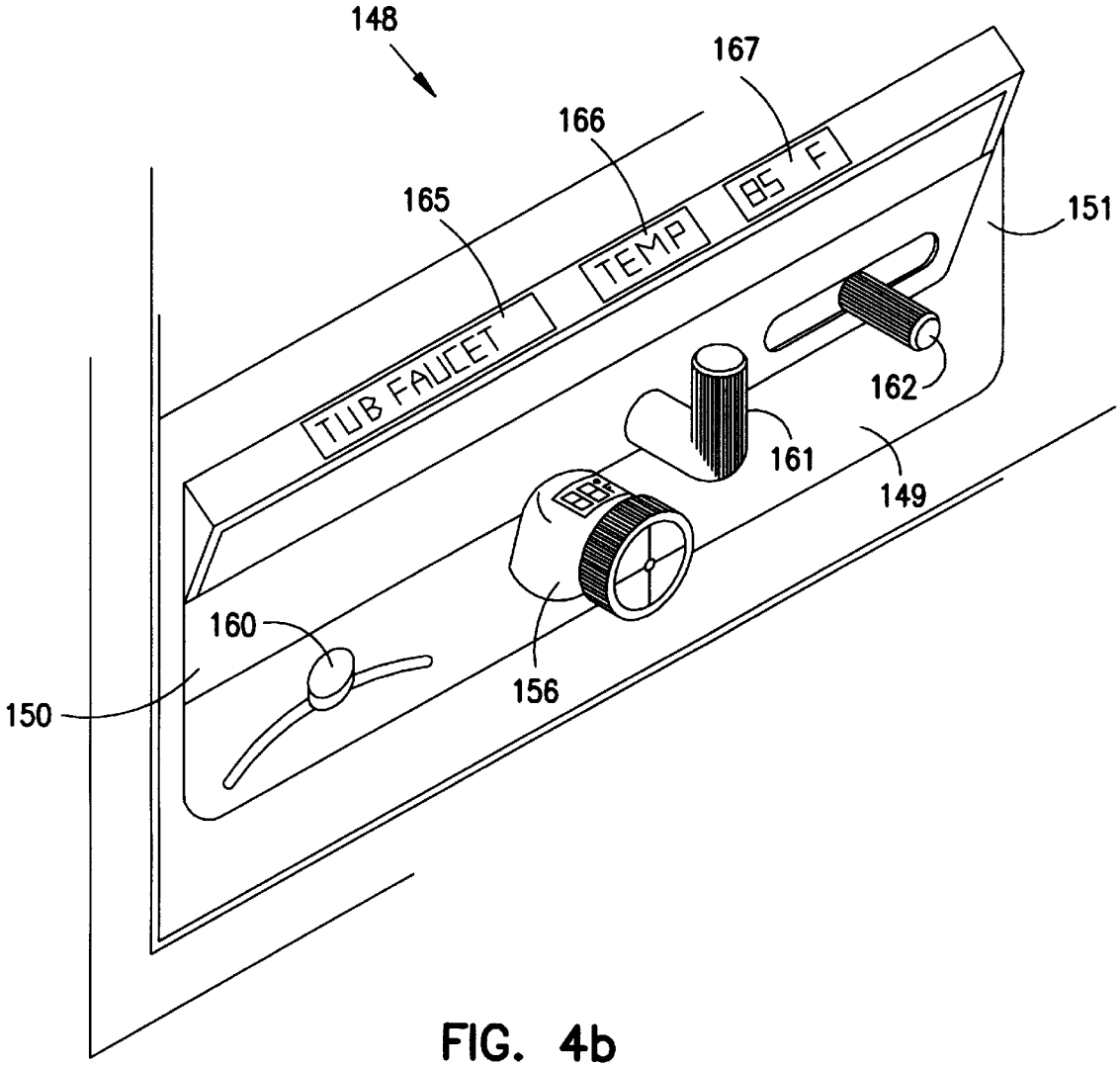
FIG. 4*b* is a perspective view of an alternative embodiment of a control and display panel.

In another embodiment, shown in FIG. 4*b*, control and display panel 148 is configured to control equipment mounted on remote panels, in addition to an article of equipment which may be mounted on its own panel. For example, control and display panel 148 may be configured to remotely control frame-mounted air heaters, ventilation means, a fixed shower head, a fixed water faucet, or any combination thereof. In such an embodiment, control panel 148 includes a microprocessor which executes instructions in accordance with a computer program stored in a memory device. The computer program comprises several subroutines, each subroutine enabling control of and display of information pertaining to a particular article of equipment. Generally, a SELECT control unit 160 generates interrupt signals which cause jumping of program control to a new subroutine, and ADJUST controls 161 and 162 control the particular equipment article selected. SELECT control unit 160 may be a sliding knob as shown which is switchable between modes for controlling alternative equipment panels; a single control button or pair of control buttons which cause program control to toggle between routines for controlling alternative panels; or a plurality of control buttons, each one designated for causing control of one particular panel.

It is seen that the embodiment of FIG. 4*b* has three displays. First display 165 displays information pertaining to the present equipment panel controlled as selected by SELECT control unit 160. Second display 166 displays the function or functions being controlled. For example, if a water faucet panel is controlled, second display 166 may alternatingly display the words "TEMP" for temperature and "FLOW" for water flow rate. Third display 167 displays the intensity of the parameter, or parameters controlled in accordance with the indicia presently appearing in second display 166.

During program routines enabling control of water faucets or showers, ADJUST controls 161 and 162 are used to adjust, respectively, water temperature and water flow rate. When a program routine enabling control of ventilation means is accessed, ADJUST controls 161 and 162 are used to control the speed of a ventilation fan. Meanwhile, when a routine enabling control of a heater or heaters is accessed, ADJUST controls 161 and 162 adjust the temperature of a thermostat. Based on the input of temperature sensors within the bathing unit, further control signals are generated to turn on a heater or heaters until a pre-set thermostat temperature is reached, and to reenergize the heater or heaters when the air temperature cools to a temperature below the thermostat temperature. Means are included for continued thermostat control of atmospheric heat during execution of routines enabling control of other equipment. Generally, when SELECT unit 160 is activated to control an equipment panel requiring control of two functions (water temperature and flow) first ADJUST control 161 is designated to control one function (e.g. heat), and second ADJUST control 162 is designated control the other (e.g. flow). When an equipment panel is controlled requiring control of one function (e.g. fan speed for a ventilation panel) either ADJUST control, 161 or 162, can be used to adjust intensity.

It is recognized that a microprocessor of a control and display panel controlling remote equipment will have multiple inputs and multiple outputs. Accordingly, control and display panel 148 further includes an input selector unit and an output selector unit. Control wires from control line 76 designated for transporting signals to the microprocessor are tied to an input selector bus and control wires designated for transporting signals from the microprocessor to remote equipment are tied to an output selector bus.

The input selector unit will pass for conversion, and then reading by the microprocessor, input voltages of one control wire at a time. The control wire voltage that is passed for conversion will depend on the value of a binary input written by the microprocessor to the input selector unit. This binary selector input value, or array of sequentially written values, will change as the currently-executed routine changes. For example, during execution of a routine enabling control of a remote shower, the program will write to the input selector a binary input causing the input selector to alternatingly pass for conversion, reading, and storage by the microprocessor the voltage of the wire designated for sensing water temperature and that of the wire designated for sensing the remote shower's water flow rate.

The panel's output selector operates on the same principal. The output voltage of the microprocessor system's digital-to-analog converter will be loaded onto one designated output control wire, the selected control wire depending on the value of a microprocessor-written binary input. This binary input value changes depending on the portion of program code being executed. It is seen that on some occasions the particular voltage of the designated output control wire will control how an article of equipment operates, such as where the signal varies the intensity of a remote heating element. On other occasions the voltage of the output control signal will merely control whether or not an equipment article operates, such as where the signal trips a relay for stopping or starting a motor.

Figure 5A:
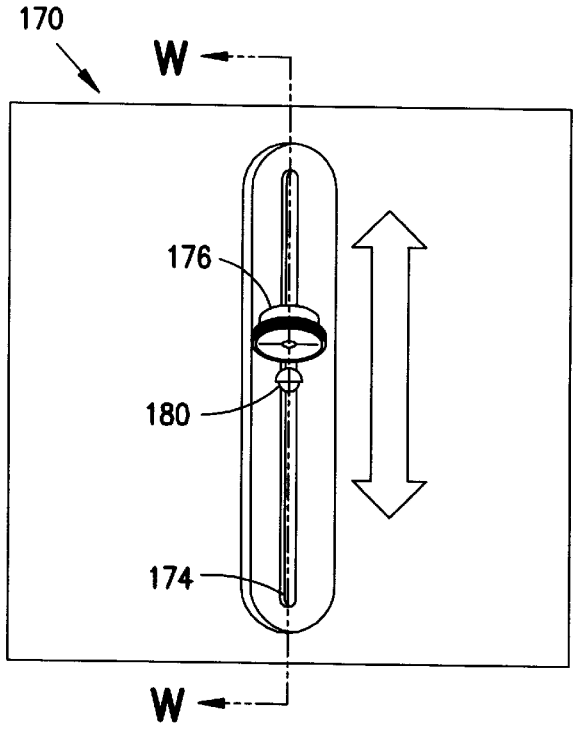
FIG. 5*a* is a front view of a shower head panel.
Figure 5B:
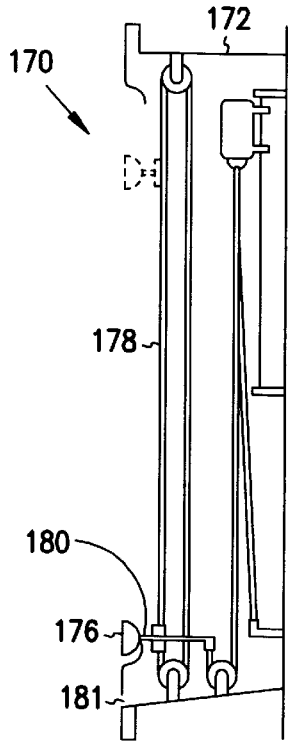
FIG. 5b (Prior Art)
FIG. 5*b* is a cross-sectional view according to section line W—W of FIG. 5*a*.

FIGS. 5*a* and 5*b* show a shower head panel 170, which is typically received in vertically-oriented medium receptacle at the above-tub region of the frame 10. The panel includes a slidably adjustable shower head as disclosed in U.S. Pat. No 4,360,159 to Haynes, which is incorporated by reference herewith. A housing 172 mounted on panel 170 includes longitudinal slot 174 which receives shower fixture 176. Shower fixture 176 is mounted to a belt 178 which rolls on rollers within housing 172 as the vertical position of fixture 176 is adjusted. Further within housing 172 are pulley means for guiding a flexible hose providing water to fixture 176. Shower fixture 176 includes a ball-socket 180 for adjusting the position of the fixture. Belt 178 is designed to minimize the amount of moisture that intrudes through slot 174 into housing 172. Nevertheless, it is expected that some moisture will intrude into housing 172. Accordingly, housing 172 includes a drainage hole 181 enabling water to drain out through the panel's front.

Figure 6A:
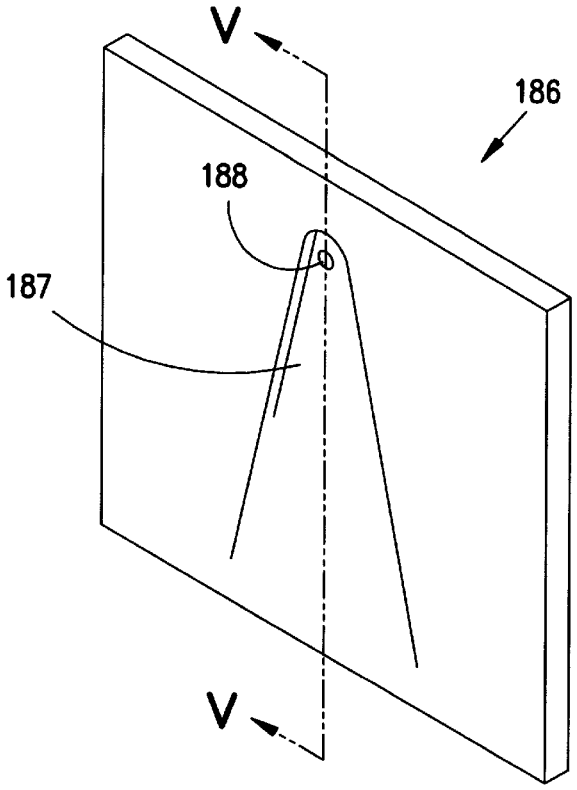
FIG. 6*a* is a perspective view of a water faucet panel mountable on the frame.
Figure 6B:
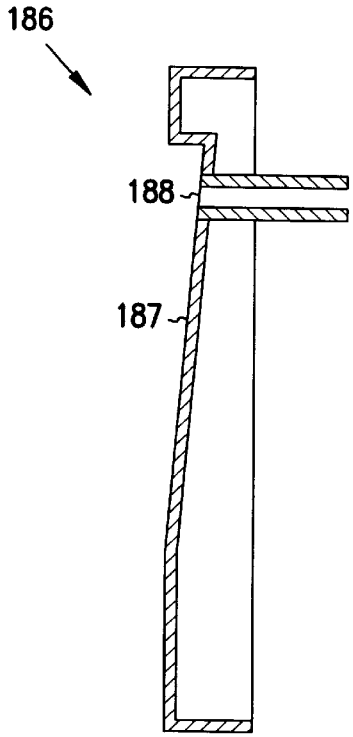
FIG. 6*b* is a cross-sectional view according to section line V—V of FIG. 6*a*.

FIGS. 6*a* and 6*b* show a water faucet panel 186, typically received within a single receptacle at the lower portion of the above-tub frame region. At the option of a user, this type of panel may supplement or replace a faucet tub panel 379 to be described in connection with FIG. 12. Faucet panel 186 comprises a recess 187 having a spout 188 disposed therein. Controls (not shown) may be mounted on panel 186 for adjusting water flow rate and water temperature. These controls may be replaced or supplemented with controls on control panel 148, as described in connection with FIG. 4*b*.

Figure 7:
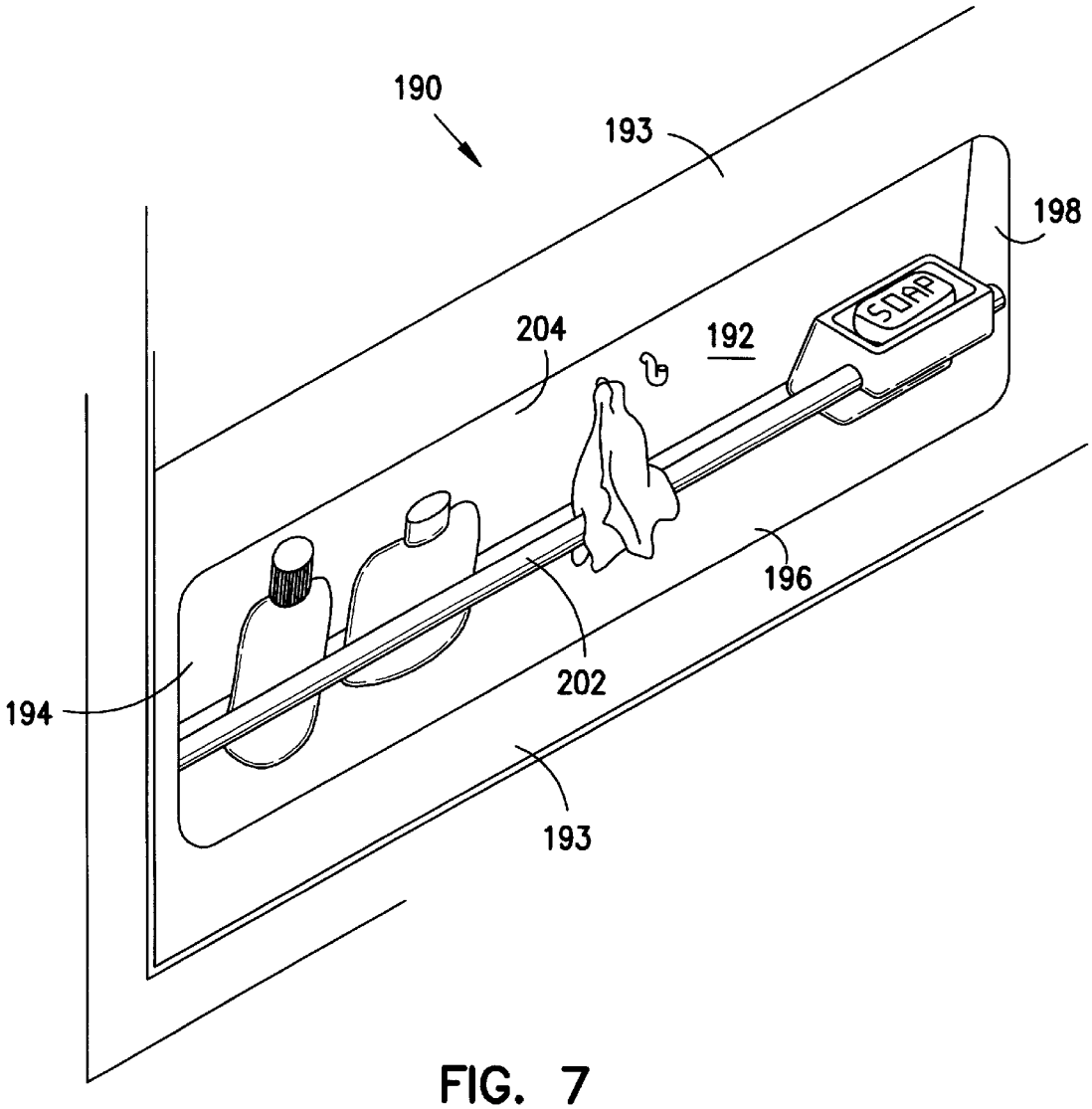
FIG. 7 is a perspective view of a storage rack panel.

FIG. 7 shows a storage rack panel 190 fittible preferably into a horizontally-oriented medium receptacle. Importantly, the rack does not extend outwardly beyond the plane of the panel surface but instead is recessed as shown so as not to present a danger to a user losing her balance. Recess 192 is defined by rear wall 194 extending from the panel surface 193 and terminating at floor 196; and sidewalls 198. Floor 196 is pitched downwardly from rear wall 194 so that articles stored within panel 190 stand at angles and are easily accessed by a user. Pitched floor 196 further impedes the accumulation of soap and other residue and debris on floor 196. Further included within storage rack panel is a rack bar 202 interposed between sidewalls 198, which prevents articles stored within the panel from falling out. At least partially forming rear wall 194 is a translucent panel 204. Mounted behind translucent panel 204 is a lamp which illuminates articles stored within the storage rack and which provides side-lighting to the frame's interior.

Figure 8A:
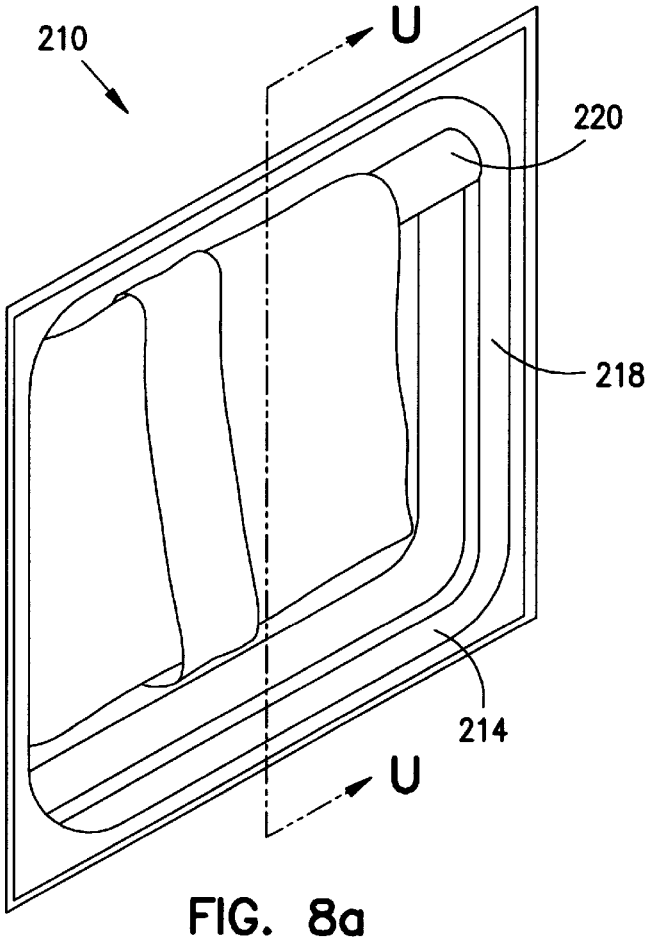
FIG. 8*a* is a perspective view of a towel rack panel.
Figure 8B:
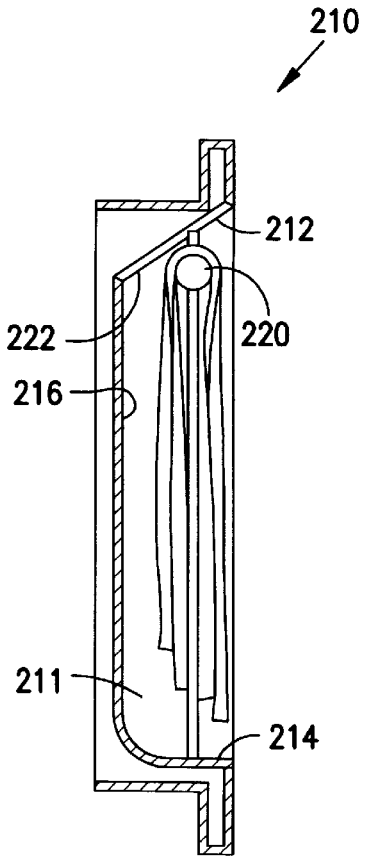
FIG. 8*b* is a cross-sectional view according to section line U—U of FIG. 8*a*.

FIGS. 8*a* and 8*b* show a towel rack panel 210 fittible typically into a large receptacle at the upper region of frame 10. Towel rack panel 210 comprises a recess 211 defined by pitched ceiling 212, floor 214, rear wall 216 and sidewalls 218. Rack bar 220 is perpendicularly interposed between sidewalls 218, preferably at the upper region of recess 211. As shown, rack bar 220 may be slidably or pivotally mounted within recess as in a grab bar 128 (see description accompanying FIGS. 3*a*–3*d*). At least partially forming pitched ceiling 212 is a translucent panel 222, above which is mounted a lamp for illuminating a towel stored on rack bar 220 and for providing side-lighting to the bathing unit's interior.

Figure 18:
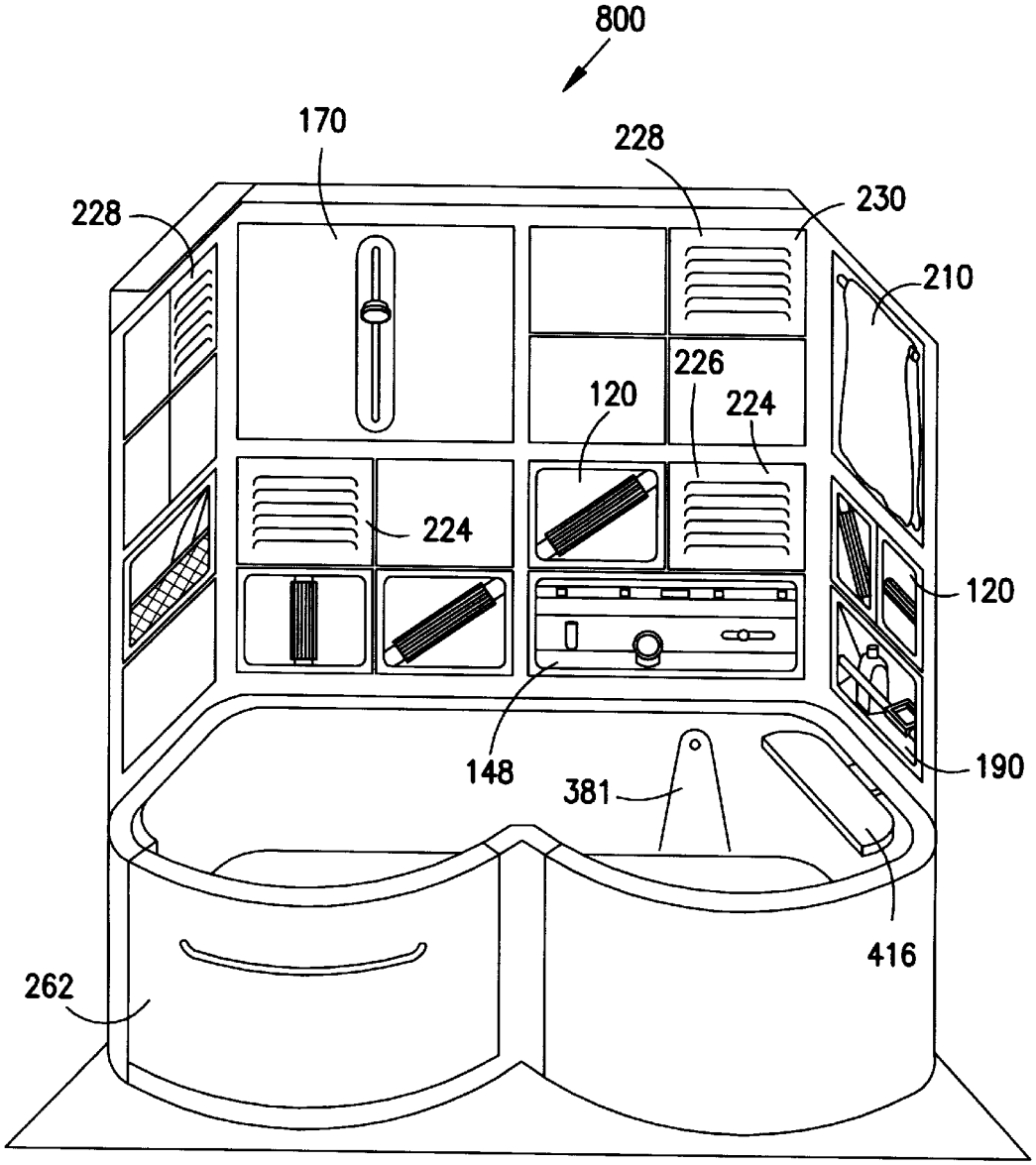
FIG. 18 is a perspective view of a representative embodiment of the invention.

Further mountable on frame 10 is a heater panel 224, the front view of which is shown in FIG. 18. The outer surface of heater panel 224 comprises a grating 226, of corrosion-resistant material. Mounted on the panel behind the grating is a heater housing comprising a motor, a fan, and a heating element. The heater housing should be completely enclosed so as to prevent the intrusion of moisture into the frame's interior through the grating.

Also mountable on frame 10 is a ventilation panel 228, the front view of which is also shown in FIG. 18. Typically installed in a third-row receptacle of the above-tub region, ventilation panel includes grating 230, and a housing mounted to panel 228 behind the grating. Within housing is a ventilation means, as are well known, for carrying away mist and fog from the bathing unit's interior. Mist and fog exit through an exhaust pipe in fluid tight connection with the housing.

Now referring to FIGS. 9 through 11, preferred bathtub designs of the present invention will be described in detail. Typically, bathtub 250 of the present invention comprises six panels including two rear panels 252 and 254, two side panels 256 and 258, a front panel 260 and a door panel 262. The rear and side panels are installed on the below-tub region of the frame. Firmly abutting one another, each of the side and rear panels extends upwardly from floor 12 of frame 10, shown in FIG. 1, and is sealed to a middle frame member 37 or 39.

Figure 9A:
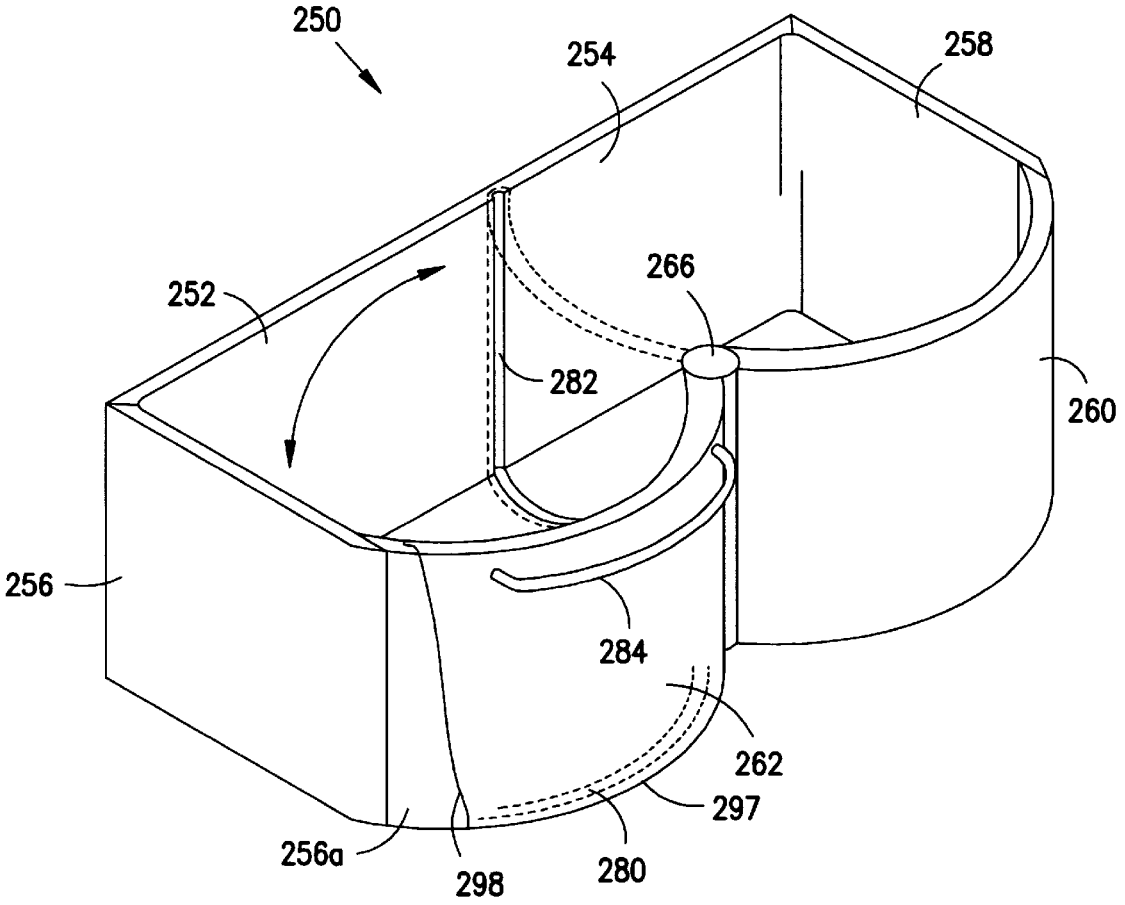
FIG. 9*a* is a perspective view of a modular bathtub having a four-position door.

Several variations for the design of the front of the tub are possible. FIGS. 9*a* and 9*b* show a bathtub having four-position door. In this embodiment, a front panel 260 abuts side panel 258 and extends to a point approximately at the center of the front portion of the floor where it terminates at a center hinge 266. Door panel 262 is hingedly connected to front panel 260 by way of center hinge 266. Front panel 260 and door panel 262 are concave to form, from a top perspective, a pair of adjoined semi-circles. Closing end 272 of door panel 262 and door receiving side panel 256 must be formed in a complementary fashion to enable both engagement of door panel 262 with side panel 256 and pivoting of door panel 262 into the tub's interior.

The four-position door embodiment of the tub is pivotable between a first open position wherein door panel 262 extends to a position outside of the tub (phantom position a); a first closed position wherein door panel 262 engages side panel 256 to define a full-size bathtub (position b); a second open position wherein door panel 262 extends to a position inside the tub (phantom position c); and a second closed position wherein door panel 262 engages with rear tub panel 254 to define a half-size bathtub (phantom position d).

Means for sealing bathtub doors in a water-tight fashion are known. Inwardly-opening bathtub doors generally have a seal disposed along a stopping surface of a door opening such that tub head pressure presses the door against the stopping surface to improve the seal between the door and the opening. Outwardly-opening tub doors generally have recess receiving means disposed in a door opening and a door-lifting means. The door is lifted and then engaged with the recess receiving means such that water head pressure produces the same seal-improving effect as in an inwardly-opening door. While less expensive to produce, inwardly-opening tub doors exhibit one important disadvantage in that bather access to the tub interior is more difficult than with an outwardly-opening door. It is seen that the four-position door embodiment of the present invention must have an outwardly-opening door since door panel 262 must necessarily swing outwardly with respect to the half-size tub configuration.

A sealing means for an outwardly-opening tub door is enabled in U.S. Pat. No. 4,802,247 to Leichle et al., incorporated by reference herewith. U.S. Pat. No. 4,802,247 discloses a bathtub door engaging a door opening having an increasing width from bottom to top. The door opening includes an elongated recess having an engaging surface facing the interior of the tub while the door itself includes a lip having a complementary engaging surface facing the tub's exterior. Water head pressure with such an arrangement works to increase rather than break the seal between the door and the opening. Since the door opening has an increasing width from bottom to top, simple vertical lowering and lifting of the door (and not additional horizontal movement) engages and disengages the door. Accordingly, the door includes a lifting mechanism for vertically lifting of the door into and out of its engaged position.

Returning to FIGS. 9*a*–9 *c*, necessary adaptations of the Leichle patent's teachings to the four-position door embodiment of the present invention will be described. It is seen that tub 250 includes two door openings: a first opening 276 defined by side tub panel 256, floor 12, and center hinge 266; and a second opening 278 defined by rear tub panel 254, floor 12, and center hinge 266. Elongated recesses 280 and 282 extend along the length of each opening and terminate at center hinge 266. The section of each elongated recess 280 and 282 formed in floor 12 are concave from a top perspective to accommodate the bottom edge of concave door panel 262. Recess sections formed in side and rear panels 256 and 254, meanwhile are formed to accommodate sloping side edge 272 of door panel 262. It is noted that, like the opening of the door of the Leichle patent, the width of door openings 276 and 278 of the present invention's four-position door embodiment increase from bottom to top. With openings 276 and 278 having increasing widths from bottom to top, vertical movement of door panel 262 engages and disengages door panel 262 with elongated recesses 280 and 282. Door panel 262 has lever 284 for operating a lifting mechanism which vertically lowers and lifts door panel 262 into and out of an engaged position within recesses 280 and 282.

FIG. 9*c* shows a detailed cross-sectional view of a recess 280 or 282 engaged with door panel 262. The view is representative of the cross-sectional characteristics of the engaged door within a recess along any point of either opening 276 or 278. Dotted lines a and b delineate the width of recess surface 279 when FIG. 9*c* indicates the view taken along line 2—2 of FIG. 9*a*. Recess 280 or 282 comprises a cavity 290 defined by an engagement surface 292 facing the tub's interior and a to stopping surface 294 facing the tub's exterior. Meanwhile, door panel's edge 296 (which includes both bottom 297 and side edges 298) comprises a lip 300 defining an engagement surface 302 facing the tub's exterior and a stopping surface 304 facing the tub's interior. When door panel 262 is lowered into recess 280 or 282, door lip 300 descends downwardly into the recess's cavity. Sloping guide surface 306 of the recess 280 or 282 guides lip 300 into cavity 290 when door lip 300 is misaligned with cavity 290 during lowering. Upon engagement, the stopping surfaces of the opening and the door 294 and 304 abut one another to prevent unwanted pivoting of the door into the tub's interior and to urge engagement surfaces 302 and 292 toward one another. As engagement surfaces are urged together, a seal strip between them 308, preferably mounted on engagement surface 302 of lip 300, is compressed. It is observed that when the tub is filled, a lateral force is exerted along the door's inner surface 310 to further urge the engagement surfaces 302 and 292 together, encouraging an improved seal between them.

Figure 9D:
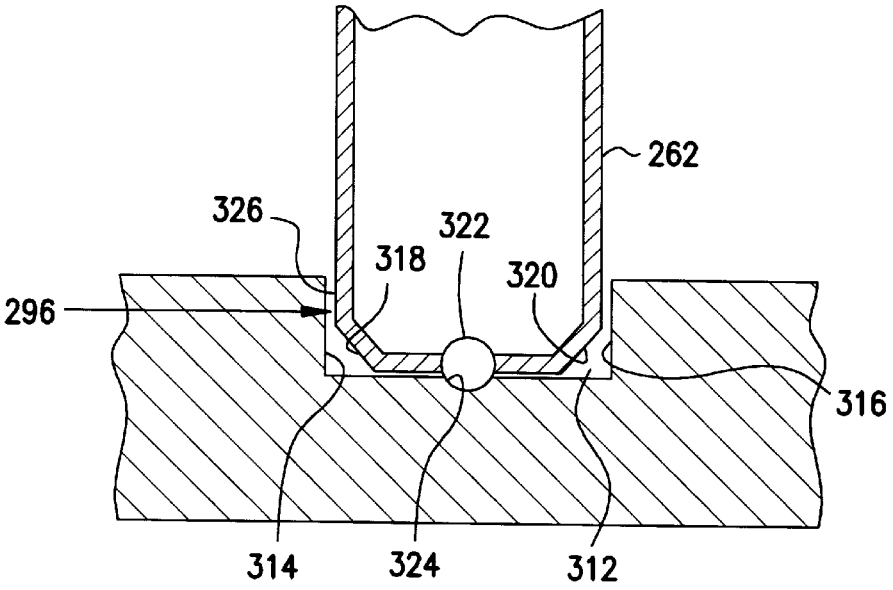
FIG. 9*d* is a cross-sectional view according to section line T—T of FIG. 9*b* illustrating an alternative sealing means for a modular bathtub door.

A novel alternative to the above approach for providing a seal between an outwardly-opening door and a door opening is illustrated in FIG. 9*d*. Cavity recess 290 of FIG. 9*c* is replaced with rectangular recess 312 having a back wall 314 and a front wall 316. Rectangular recess 312 does not receive a lip extending from edge 296 of door 262, but rather has a width slightly larger than that of the door such that it receives the entire door edge 296. Door edge 296 comprises tapered guide surfaces 318 and 320 for guiding edge 296 into recess 312 when edge 296 is slightly misaligned during lowering. Inflatable or noninflatable gasket 322 affixed generally to the end of edge 296, engages groove 324 of recess 312 to provide a seal between door 262 and opening 276 or 278. An additional gasket which compresses (engaging back wall 314) when encountering water head pressure may be attached to engagement surface 326 of edge 296. The bathtub doors may be sealed in water-tight fashion according to many other methods which are well known to those skilled in the art.

Now referring to FIGS. 10*a* and 10*b*, the design of the four-position door embodiment's center hinge 266 will be described in detail. Traditionally, the gap between the edge of a tub at which a door is hinged and a tub door is sealed by way of a gasket interposed between them which is compressed when the door is in a closed position (see for example gasket 358, FIG. 11*a*). This approach cannot be used in the present invention's four-position door embodiment because the four-position door has more than one closed position. Accordingly, a novel center hinge is disclosed for enabling the four-position door.

Center hinge 266 comprises two elongated notches extending the length of its outer surface. First notch 326 receives hinge-side edge 328 of door 262 when tub 250 is in a full-size configuration (position b), and second notch 330 receives hinge-edge 328 of door 262 when tub 250 is in a half-size configuration (phantom position d). Hinge-side edge 328 preferably has a ridge 332 extending outwardly therefrom, which is received by notch 326 or 330. A seal between notch 326 and ridge is provided by inflatable or noninflatable gasket 334. When tub 250 is filled, head pressure will be exerted along the inner surface of door 262 as illustrated by force line F. At center hinge 266, head pressure forces will be transmitted by engaging surface 336 of ridge 332 and will be received by stopping surface 338 of center hinge 266. An additional seal (not shown) may be interposed between engaging surface 336 and stopping surface 338 which compresses and thereby improves when the tub is filled.

Figure 10A:
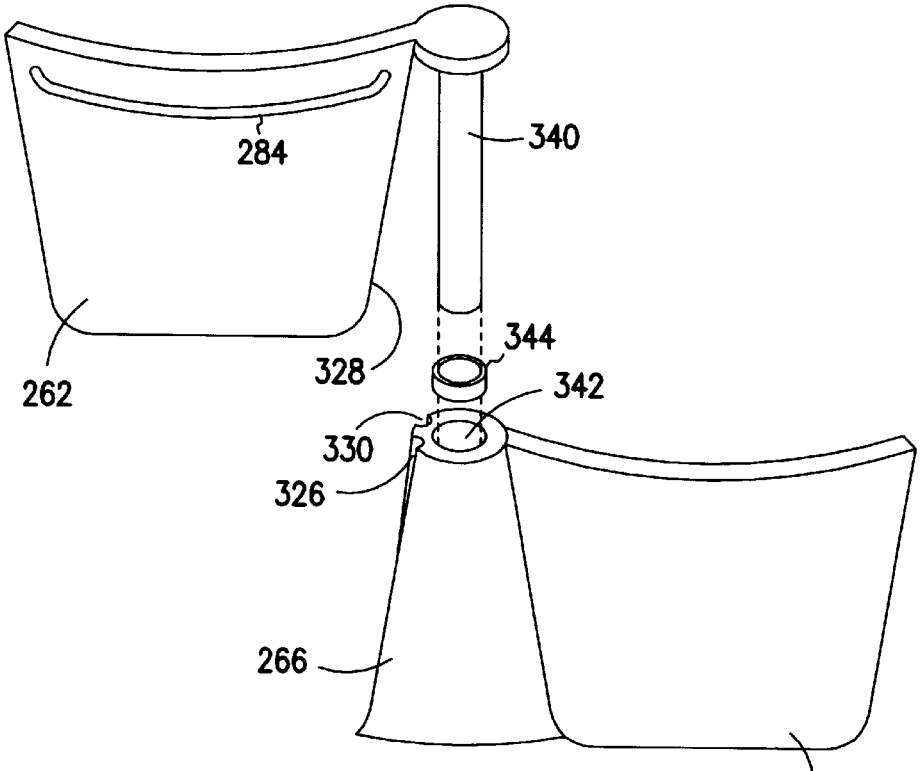
FIG. 10*a* is an exploded view of a modular bathtub door.
Figure 10B:
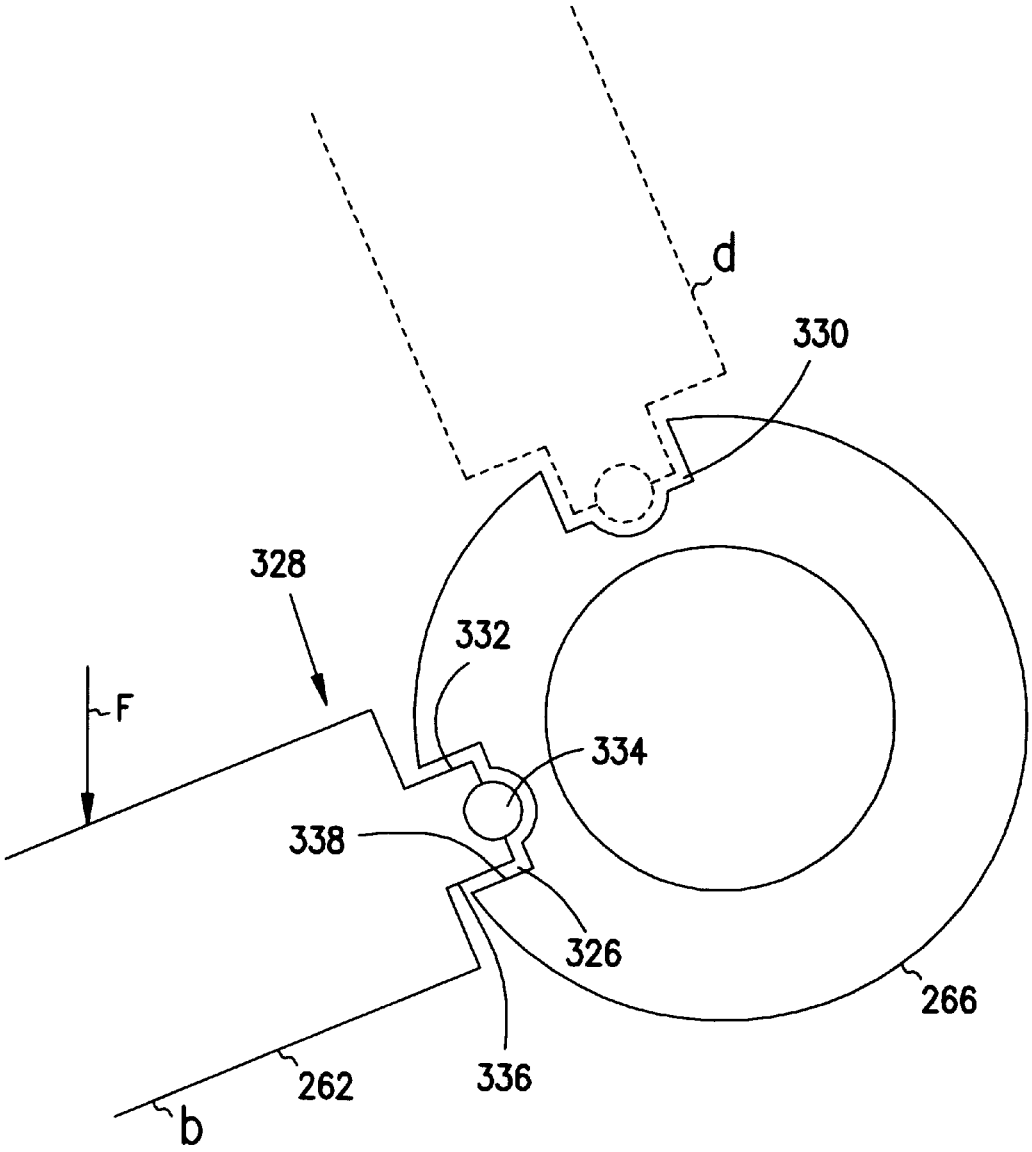
FIG. 10*b* is a top view of center hinge of a modular bathtub door.

Referring specifically to FIG. 10*a*, it is seen that center hinge 266 is slightly cone-shaped having a decreasing diameter from bottom to top. Hinge-side edge 328 of door 262 is complementarily contoured, as shown. Configured in this fashion, simple vertical lifting of door 262 completely disengages door ridge 332 from notch 326, allowing door 262 to swing freely from position b to phantom position d, where it may be lowered to engage second notch 330 (FIG. 10*b*). For vertical lifting and lowering of door 262, door 262 is attached to stem 340, which is inserted into hole 342 of center hinge 266. A bearing ring 344 may be provided for improving the alignment and pivotability of stem 340 within hole 342. Lever 284 may operate a mechanical lifting mechanism within the center hinge or may generate a control signal for energizing a motorized lifting mechanism disposed within center hinge 266.

When a four-position door embodiment is used in a full-size tub configuration, elongated recess 282 of the floor and the edge-receiving rear tub panel is exposed. In-tub recess 282 may be temporarily filled with a manually removable spacer (not shown) which is complementarily shaped to be fitted into the recess. The four-position door embodiment of the tub is preferred where a user would derive benefit from a bathtub that is collapsible to a half-size formation. The classification of users who would benefit from such a design, as will be discussed in detail, is the classification of persons requiring assistance in bathing. If a user would not benefit from a collapsible bathtub, it is preferred, for cost-saving purposes, that the tub comprise a two-position door.

Figure 11A:
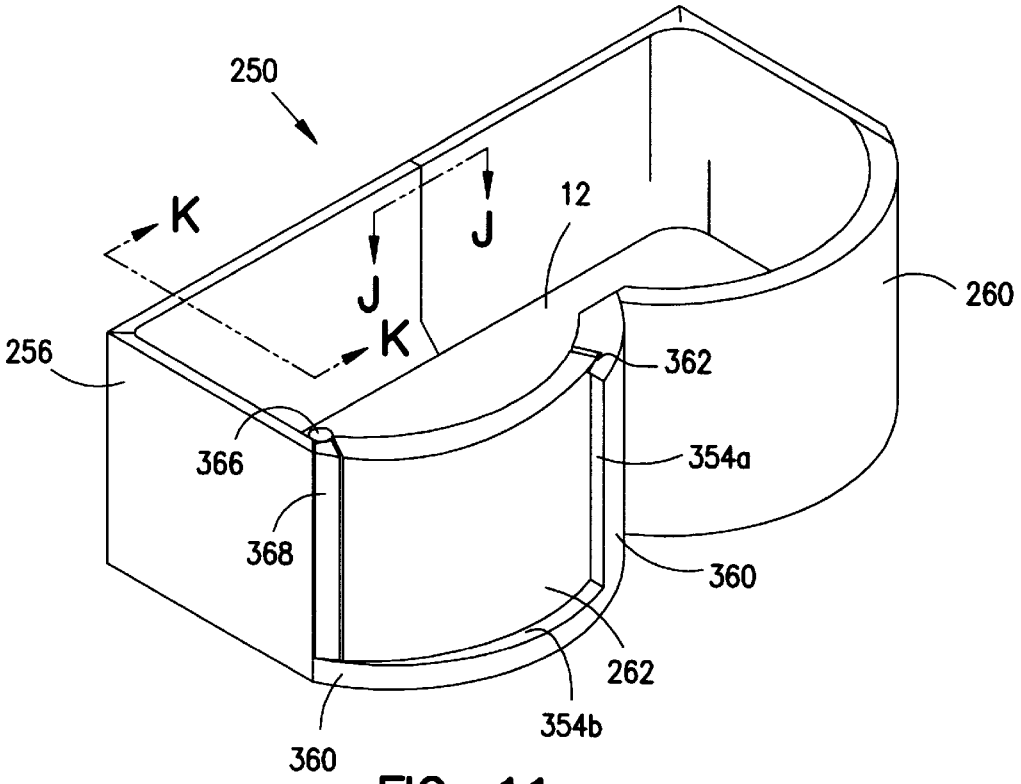
FIG. 11*a* is a perspective view of an embodiment of the invention having a two-position door.
Figure 11B:
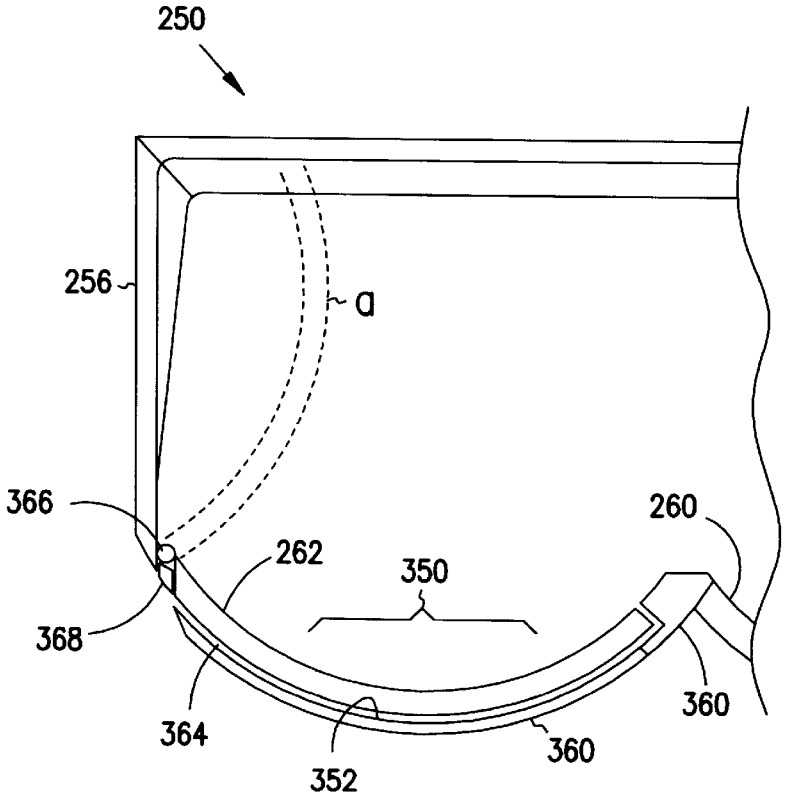
FIG. 11*b* is a partial top view of the modular bathtub of FIG. 11*a*.

A two-position door embodiment of the present invention is shown in FIGS. 11*a* and 11*b*. Door panel 262 of the two-position door embodiment is pivotable between a closed position defining a full-size bathtub and an open position wherein door panel 262 extends to a position inside the tub (see phantom position a of FIG. 11*b*).

It is easily observable that a two-position door embodiment of the invention could be formed simply by deleting inside-tub recess 282 (FIGS. 9*a* and 9*b*) and by modifying center hinge 266 such that closing of door panel 262 compresses a seal strip to form a water tight seal between the front and door panels 260 and 262. Nevertheless, the two-position door embodiment preferably includes an inwardly-opening door since, as mentioned, such doors are less costly and easier to produce than outwardly-opening doors. Inwardly-opening doors are enabled in U.S. Pat. No. 4,360,935 to Barret, Sr. and in U.S. Pat. No. 5,163,187 to Dannenberg et al., both of which are incorporated by reference herewith.

The Barret patent discloses an inwardly-opening door which engages a stopping surface formed at a door opening, the stopping to surface having a resilient but noninflatable seal strip mounted extensively thereon. Head pressure from water in the tub increases the sealing action to cause a water-tight seal to be formed between the door and the stopping surface. The Dannenberg patent teaches a tub door having many of the same features as the Barret tub, except that the resilient noninflatable seal is replaced by an inflatable seal. A tube disposed within a door hinge provides air to a seal mounted on the edge of a tub door. Air is provided to and released from the seal as required based on the output of water level sensors disposed about the door.

Returning to FIGS. 11*a* and 11*b*, door opening 350 of the present invention's preferred two-position door includes a stopping surface 352 formed by a continuous ridge 354 defined by ridge spacer 360. A seal strip 362 extends the length of stopping surface 352 such that a seal is formed when door panel 262 is pivoted to a closed position wherein its edges abut stopping surface 352. Not shown in FIG. 11*b*, seal strip 362 is disposed in the gap 364 formed between ridge 354 and closed door 262, and is affixed to stopping surface 352. It is seen that seal strip 362 is compressed and thereby the seal between door panel 262 and opening 350 is further improved when the tub is filled to create head pressure exerting a lateral force on the inner surface of door panel 262.

In the preferred two-position door embodiment, center hinge 266 of the four-position door embodiment is replaced with ridge spacer 360 having a vertical ridge 354*a* for receiving a door panel's side edge, and a horizontal ridge 354*b* for receiving a door panel's bottom edge. Ridge spacer 360 is configured to be attached to front-panel 260 and floor 12 in water-tight relation thereto. It is seen further that recess spacer 256*a* of the four-position embodiment is deleted, and instead, interior-mounted hinge 366 is attached directly to side tub panel 256. Mounting interior-mounted hinge 366 to side tub panel 256, and not at the location of center hinge 266, enables easy access to the tub's 250 interior. Gasket 368 is compressed to form a seal between door panel 262 and side tub panel 256 when door panel 262 is in a closed position.

If no foreseeable users suffer from limited locomotive ability, it is preferred that the tub include no door. A doorless embodiment of the tub is best realized by way of an elongated front panel (not shown) which is interposed between the side panels 256 and 258 of the tub. Front panels 260 and 262 may be removed entirely, and the unit becomes a shower, enabling wheelchair access to the unit's interior.

Like the panels fittible into receptacles of the upper portion of the frame previously described, the bathtub panels may have mounted thereon or have disposed therein various equipment for use in bathing. Preferably comprised of molded fiberglass or acrylic, bathtub panels are not interchangeable in the same way as the above-tub panels since a different panel configuration is generally required for fitting into each tub panel receptacle. Flexibility of design is nevertheless facilitated since multiple embodiments of each panel are possible. For example, a premanufactured right rear tub panel may have mounted thereon a fixed seat, a lift mechanism, a water faucet, or other types of equipment, the particular embodiment of each tub panel being selected by the user.

As indicated, options which the tub panels may embody include a water faucet, a fixed seat, or a seat having a lift mechanism. Further, front panel 260 may have a pivoting seat mounted thereon. Additionally, it has been indicated that a four-position door embodiment of the present invention will have a rear tub panel 254 with a recess 282 disposed therein as described above for engaging a tub door.

Of course, if none of the above options is required by a user, the user may option to have a plain tub panel installed having no equipment mounted thereon. It is observed that if a user selects for installation two or more adjoining tub panels having no equipment mounted thereon, that such adjoining plain panels may be replaced by a single large panel that extends the length of the adjoining plain panels, and which is fittible into the frame receptacles which would normally receive the grouping of adjoining panels. Similarly, it is observed that if a user requires no specialized equipment mounted within the bathtub, and does not require door means for improved access to the tub, that the paneled tub may be replaced with a conventional bathtub comprising a contiguous article of manufacture, and having apertures therein only for reception of a water faucet and a drain grating.

Figure 12A:
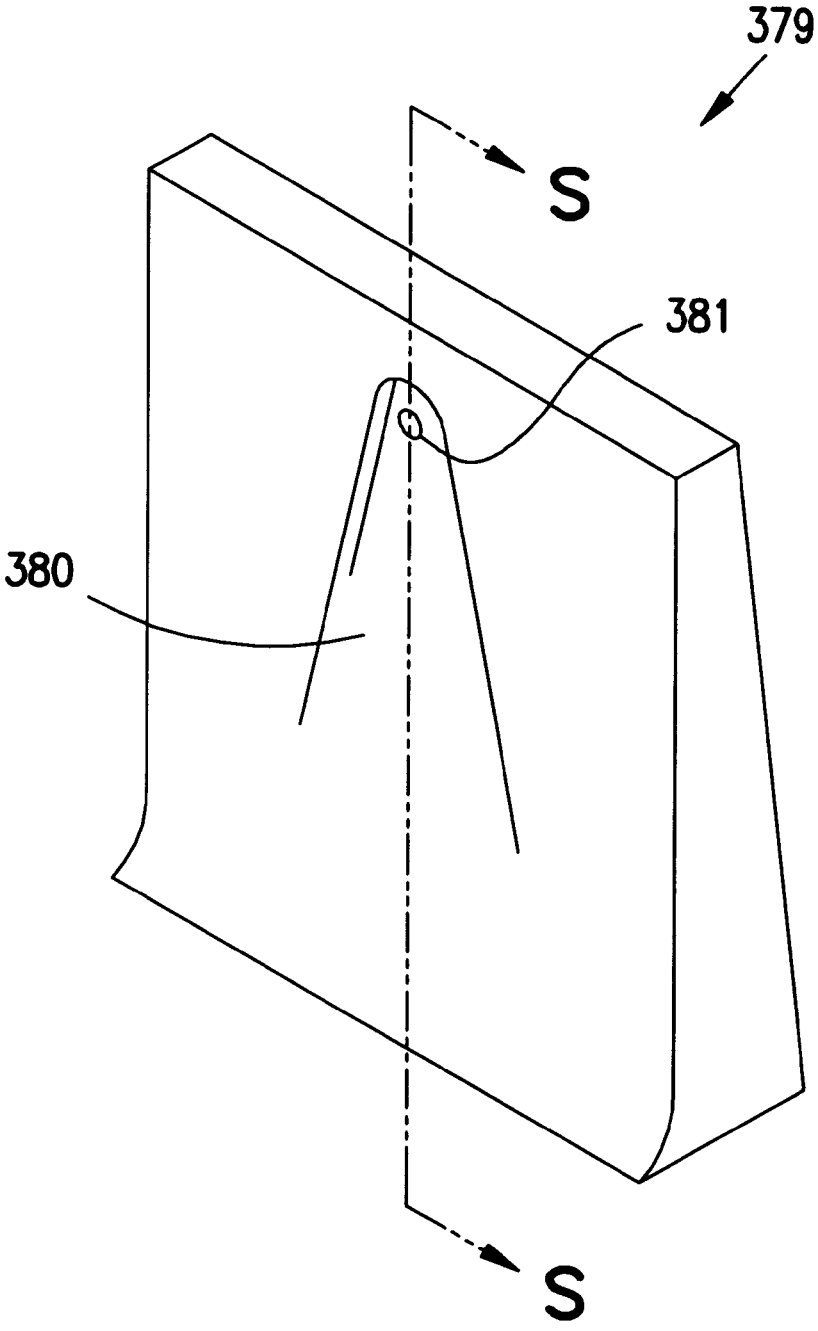
FIG. 12*a* is a perspective view of a tub panel mountable on the frame having a water faucet disposed thereon.
Figure 12B:
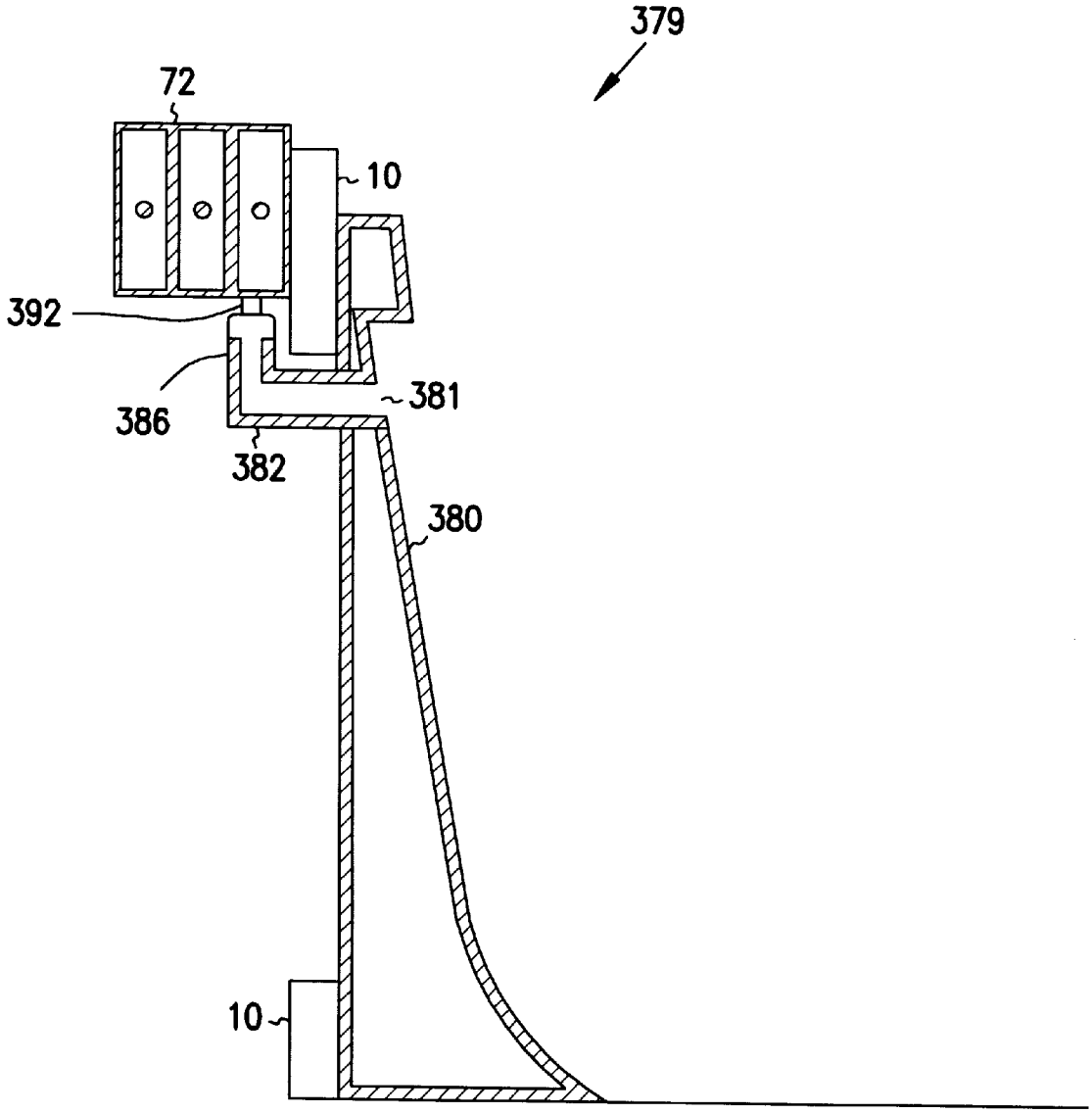
FIG. 12*b* is a cross-sectional view according to section line S—S of FIG. 12*a*.

Now referring to FIGS. 12–15, features of equipment which may be mounted on the various bathtub panels will be described in detail. FIG. 12*a* and 12*b* show a bathtub panel having a water faucet. Tub faucet panel 379 is typically mounted on side tub panel 256 or 258 but may also be mounted on rear panel 252 or 254. Like the above-tub faucet panel 186 described in connection with FIG. 6*a* and 6*b*, tub faucet panel 379 includes a recess 380 having a spout 381 disposed therein. It is seen that rigid pipe 382 extends rearwardly from panel 379 and then upwardly to terminate at a female end 386. As the faucet tub panel 379 is installed, female end 386 is simultaneously fitted into a pipe node 390 having pipe 392 extending downwardly from conduit 72. Returning to FIG. 1, it is seen that in addition to having multiple access nodes for providing water, control signals, and electricity to above-tub panels, conduit 72 has four specialized pipe nodes 390 facing downwardly for providing water to a water faucet which, at the option of the user, may be mounted on any one of the four in-tub panels. When faucet tub panel is installed in frame 10, rigid pipe 382 is simultaneously fitted into pipe node 392, and secured by well-known pipe securing means.

Like the shower panel 170 and the faucet panel 186 described previously, faucet panel 379 may have a manual closing valve or alternatively a motorized closing valve controlled by controls mounted to faucet panel 384. Temperature of water flowing out of the faucet is adjusted by means of controls which are interfaced with the bathing unit's control line 76 and mounted to faucet panel 379. Of course, as has been discussed previously, these faucet-mounted controls may be supplemented by or replaced with controls mounted to a control panel 148.

Figure 13:
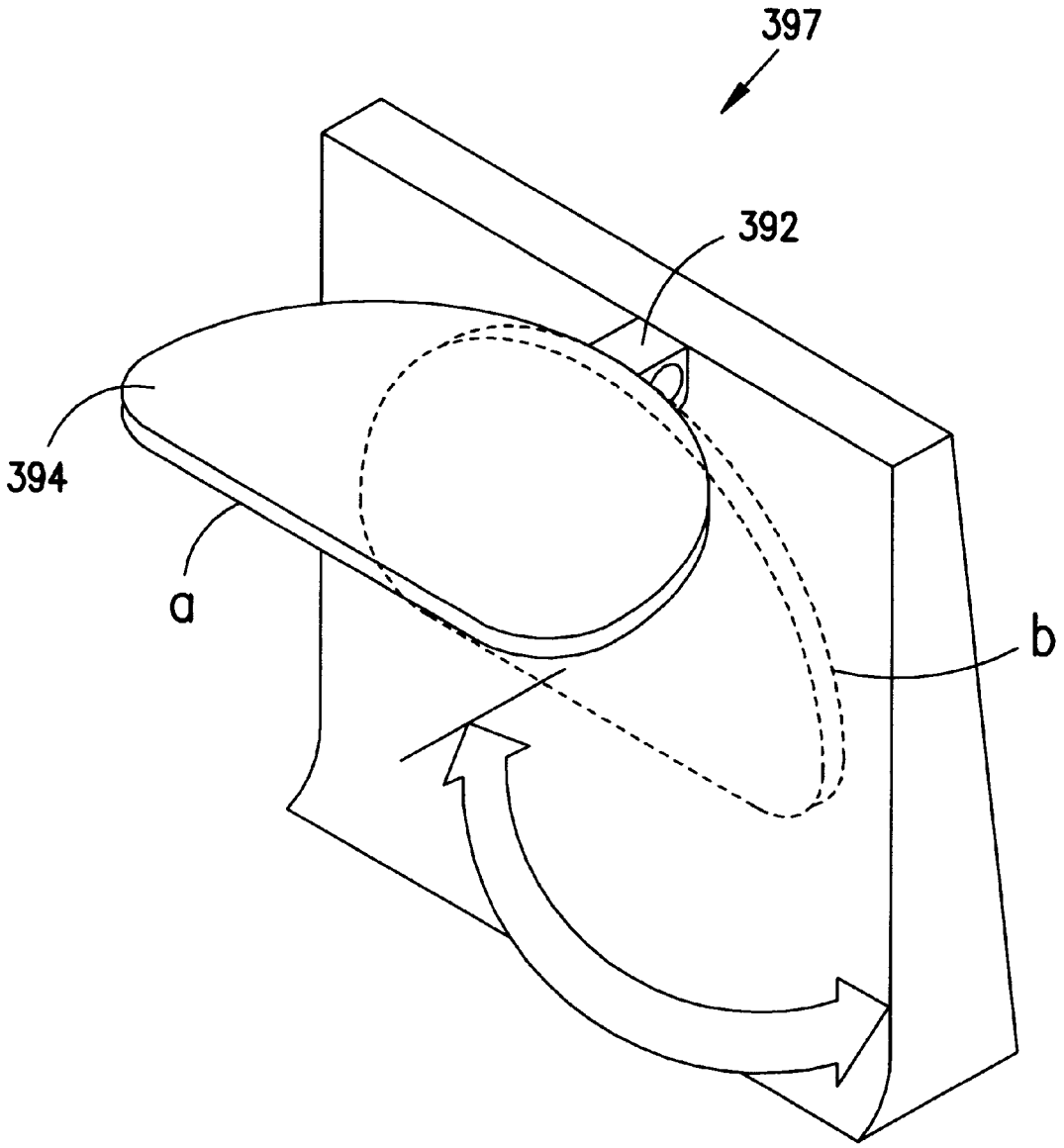
FIG. 13 is a perspective view of a tub panel having a collapsable bathers seat.

FIG. 13 is a perspective view of a bather seat tub panel 397. Panel 397 includes a mount 392 having seat 394 pivotally attached thereto. Seat 394 is pivotable between a first position wherein seat 394 rigidly extends outwardly to the tub's interior (position a) and a second position wherein seat 394 extends downwardly, as illustrated by phantom position b. Mount 392 includes means for enabling such pivoting and means for mounting said seat in said first position.

FIGS. 14*a* through 14*d* show a tub lift panel 410. Tub lift panel 410 has an elongated slot 412 having a mount 414 extending forwardly therefrom. Mount 414 typically receives a liftable bathers seat 416, but may alternatively receive an infant tray 910 to be described in connection with FIG. 20. Defining the bottom rear of slot 412 is cylinder 418 of pneumatic jack 420. Pneumatic jack 420 further includes a piston 422 extending upwardly therefrom and terminating in curved bar 423, upon which mount 414 is attached. It is seen that by operating jack 420, seat (or infant tray) may be moved from a high position (position a) to lower positions, as phantom position b illustrates. Splash wall 419 may be installed in slot 412 in front of cylinder 418 to hide cylinder from view. Slot 412 is defined by curved slot wall 413.

Jack valve motor (not shown) or other jack motors may be disposed within panel 410, but must be housed such that moisture cannot intrude through slot to the motor. Typically, a lift panel will have two tails extending rearwardly therefrom. First tail 424 is an electrical line for powering jack motor(s), and second tail 425 is a control line which transports control signals from control and display panel 148 to jack 420. These lines are interfaced with access nodes 110 of conduit 72. Controls installed on lift panel (not shown) for controlling pneumatic jack 420 may supplement or replace jack control routines of the computer program of control and display panel 148.

Alternatively, jack 420 may not include a motor, but instead may have a manually-operable valve as in a contemporary office chair having a pneumatic lift mechanism. A manually-operable valve may be operated by way of a lever installed on mount 414 (not shown).

Figure 14A:
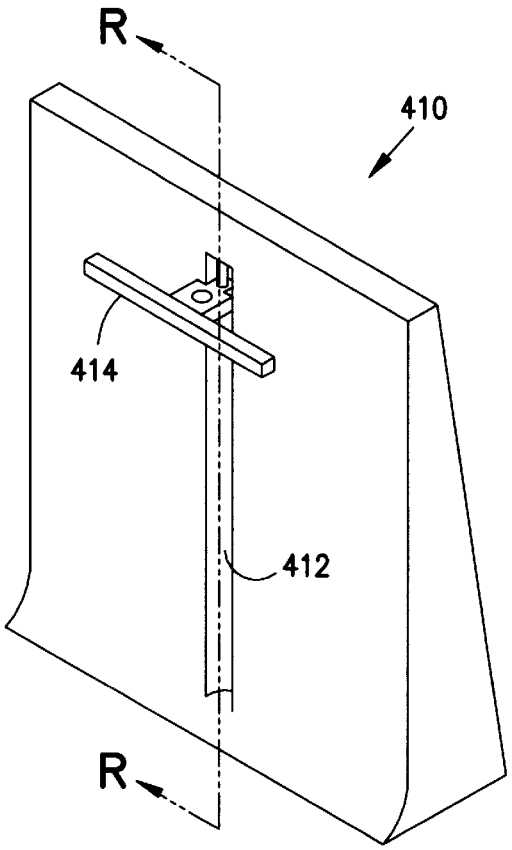
FIG. 14*a* is a perspective view of a tub lift panel.
Figure 14B:
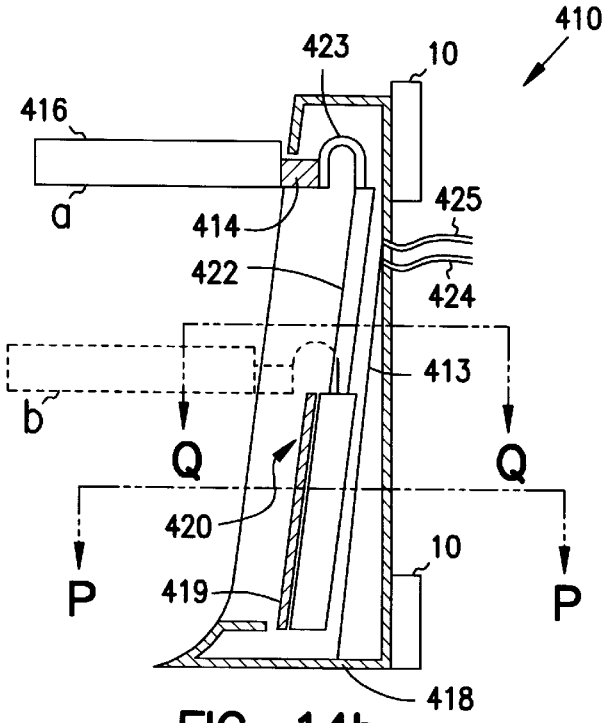
FIG. 14*b* is a cross-sectional view according to section line R—R of FIG. 14*a*.
Figure 14C:
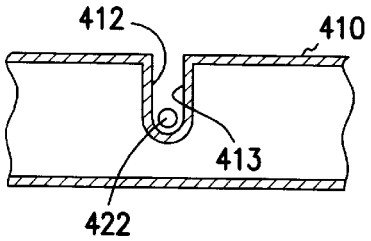
FIG. 14*c* is a cross-sectional view according to section line Q—Q of FIG. 14*b*.
Figure 14D:
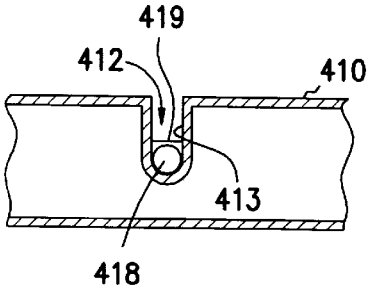
FIG. 14*d* is a cross-sectional view according to section line P—P of FIG. 14*b*.
Figure 14F:
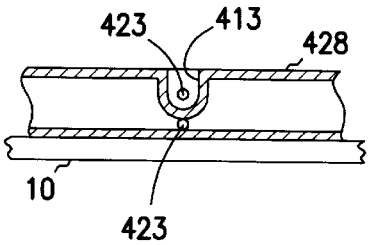
FIG. 14*f* is a cross-sectional view according to section line O—O of FIG. 14*e*.
Figure 14G:
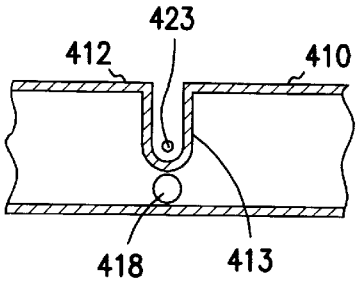
FIG. 14*g* is a cross-sectional view according to section line N—N of FIG. 14*e*.
Figure 14E:
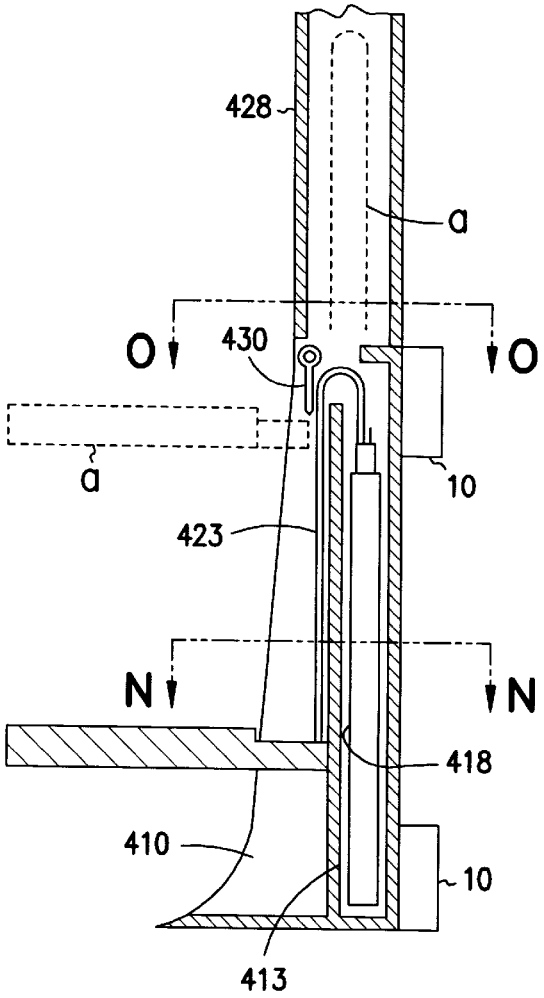
FIG. 14*e* is a cross-sectional view according to section line R—R of FIG. 14*a* illustrating an alternative embodiment of a tub lift panel.

FIGS. 14*e* through 14*g* show a variation of the above-described lift panel design. In the alternative embodiment, slot wall 413 extends upwardly and outwarldly from lift panel 410 and terminates inside of modified above-tub panel 428. Modified above-tub panel 428 includes a cavity allowing free vertical movement of elongated curved bar 423 within modified panel 428, as illustrated by phantom position a. The outer surface of modified panel 428 is extended forwardly so that is flush with the outer surface of lift panel 410, and the gap between lift 410 and modified above-tub 428 panels is sealed by gasket 430 or by other sealing means. It is seen that the water level in the tub must rise above the tub level before water can intrude through slot 412 into the interior of lift panel 410. The embodiment thereby prevents exposure of jack 420 to water.

Figure 15:
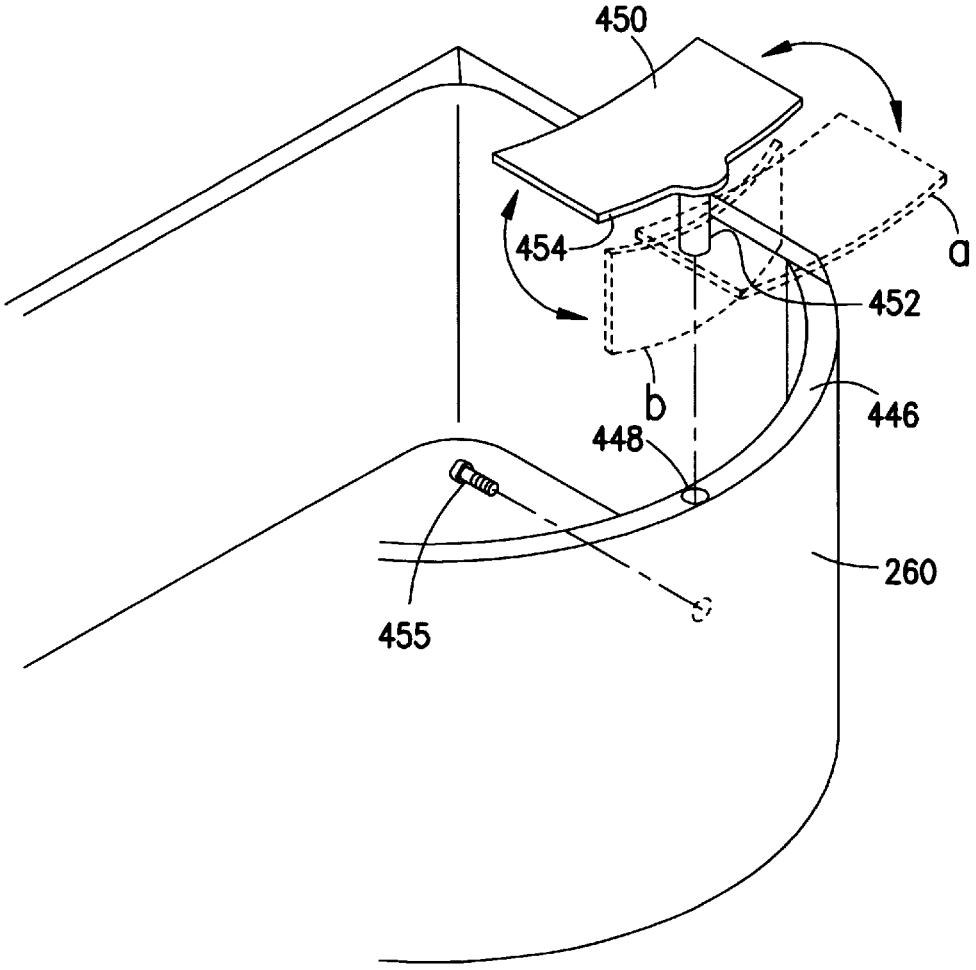
FIG. 15 is a perspective view of a caregiver seat of the present invention as installed in a front tub panel.

FIG. 15 is a perspective view of a front panel 260 having a caregiver seat mountable thereon. Top surface 446 of front panel has a hole 448 bored therein. Caregiver seat 450, meanwhile, has a stem 452 extending downwardly from edge 454 of seat 450. Caregiver seat 450 is installed simply by inserting stem 452 into hole 448. The diameter of hole 448 must be slightly larger than the diameter of stem 452 so as to enable insertion of stem 452 into hole 448, and pivoting of stem 452 within hole 448. A ring bearing or bearings (not shown) receiving stem 452 may be installed in hole 448 for improving the pivotability of seat 450. It is noted however that if hole 448 is too much larger than stem 452, that seat 450 may be unstable. In the alternative, a pivot means is provided between seat 450 and stem 452 and stem 452 is anchored in hole 448, perhaps with screw 455. Caregiver seat 450 is pivotable between a first position wherein seat 450 extends to the tub's interior and a second position wherein seat 450 extends to a position outside of the tub (phantom position a). In the first position, caregiver seat 450 is generally used by a caregiver providing care to a bather seated within a tub on a bathers seat. In the second position, caregiver seat 450 may be used by a bather, for example where a bather undresses before bathing or dries off after bathing. Seat 450 further has vertical pivoting means, and locking means, as are well known, for vertically pivoting of seat into a collapsed downward position (phantom position b), and for locking of seat 450 into a horizontal in-use position.

Method of Installation

It is intended that the bathing unit be of standard size and be fittible into the wall space of a home or a building reserved for standard-sized bathtubs.

Figure 16A:
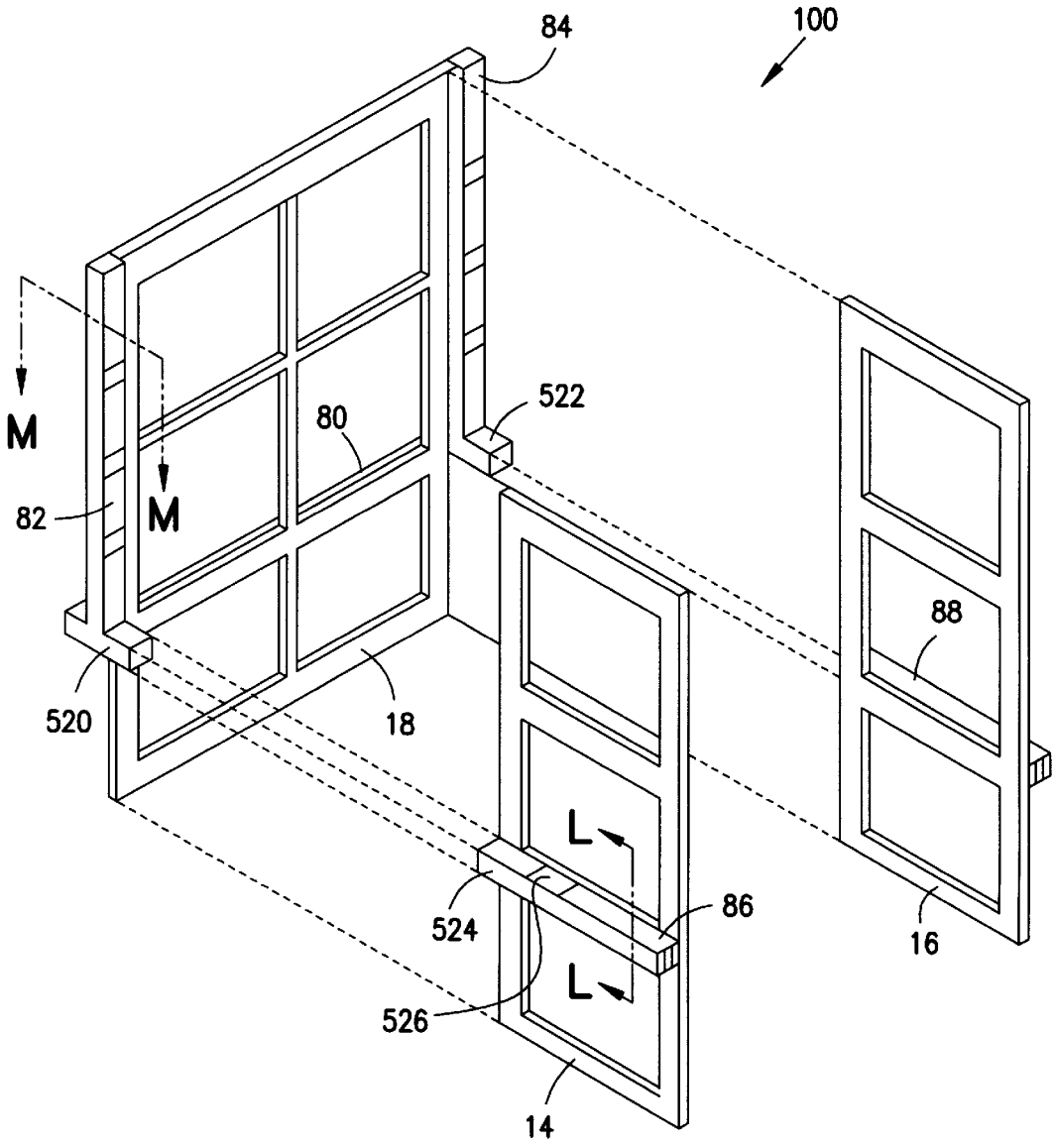
FIG. 16*a* is perspective installation detail illustrating a means for interfitting sidewalls of the frame with the frame's rear wall.
Figure 16B:
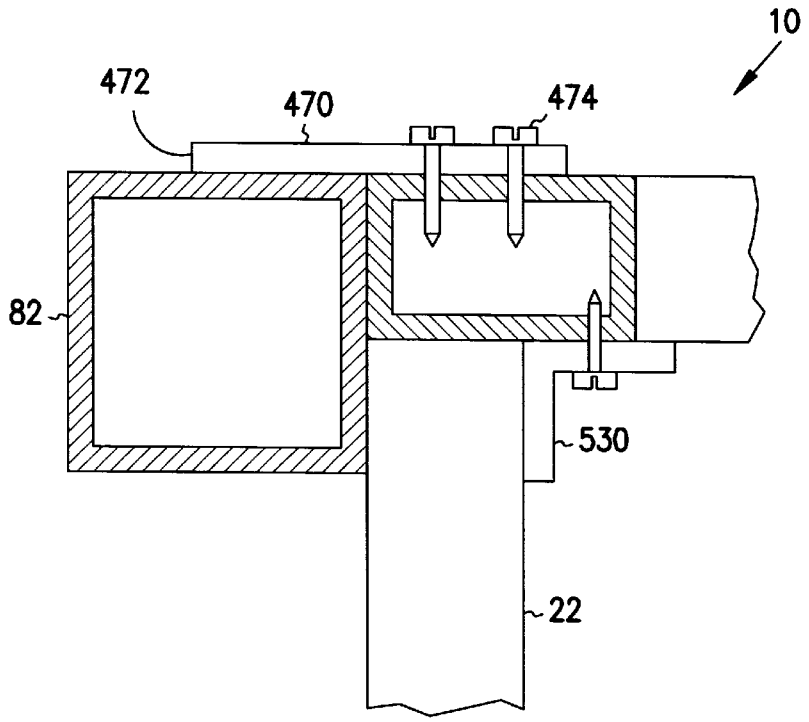
FIG. 16*b* is cross-sectional view according to section line M—M of FIG. 16*a*.
Figure 16C:
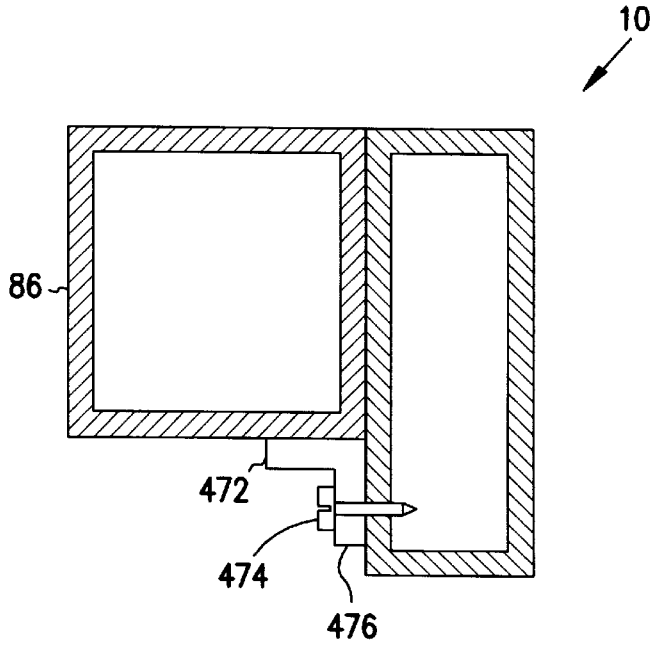
FIG. 16*c* is cross-sectional view according to section line L—L of FIG. 16*a*.

Before frame 10 is transported to the location of installation, conduit sections 80, 82, 84, 86, and 88 are attached to their prescribed frame walls as shown in FIG. 16*a*. The sections may be attached to frame 10 by welding or by other well-known attachment means. Preferably, conduit sections 80, 82, 84, 86, and 88 are premanufactured to have tabs extending therefrom for attaching to frame 10. As shown in FIG. 16*b*, corner conduit section 82 a plurality of straight tabs 470, which are welded to conduit 72 by means of a weld 472 and attached to frame 10 by means of screws 474 which penetrate aligned holes of tabs 470 and frame 10. Rear 80 and feeder conduit sections 86 and 88, as illustrated by FIG. 16*c*, have L-tabs 476 welded to conduit 72 by means of a weld 472 and attached to frame 10 by means of screws 474. Preferably, rear 80 and corner conduit sections 82 and 84 are premanufactured to be one piece, and are attached to rear wall 18 as a single unit.

Referring to FIG. 16*a*, it is seen that frame 10 comprises four distinct interfitting parts when it is transported to the location of installation: A floor (not shown); a rear wall 18 having corner and rear conduit sections attached; and two sidewalls 14 and 16, each having a conduit feeder section attached.

The first installation step is installing floor 12. Generally, floor 12 is laid on the floor boards within a building's wall space reserved for a bathing unit where it is secured, and its drain hole (not shown) is interfaced with the building's drainage system by well-known methods. Spaces must be left between floor 12 and wall studs to allow for subsequent installation of rear wall 18 and sidewalls 14 and 16, and floor 12 should be substantially square with wall studs facing its rear and sides.

Figure 16D:
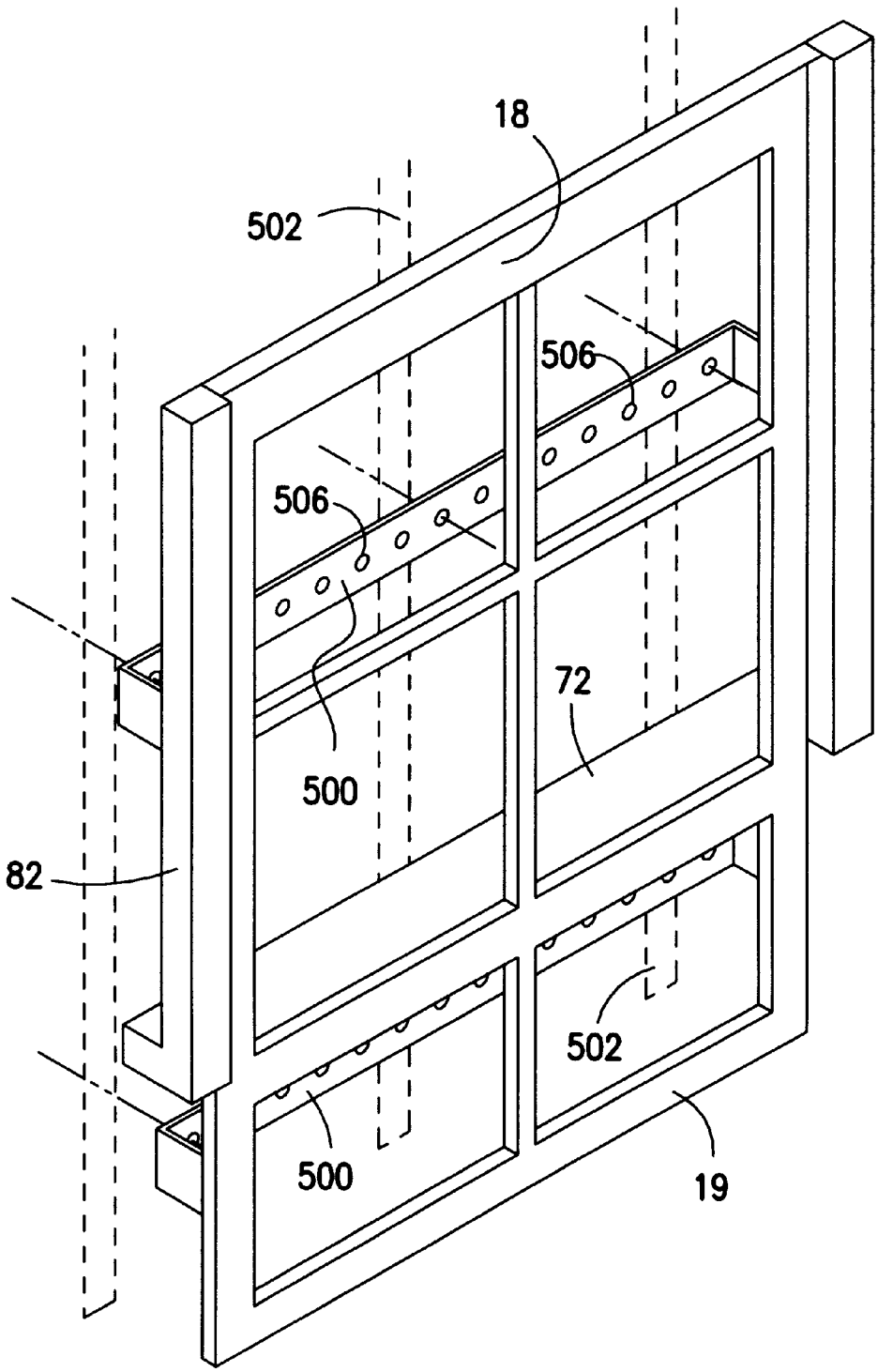
FIG. 16*d* is a perspective installation detail illustrating means for attaching the rear wall to studs of a wall space.

Rear wall 18 having conduit sections 80, 82, and 84 attached is installed as illustrated by FIG. 16*d*. Bottom rear frame member 19 is abutted against floor (not shown) to ensure alignment of floor 12 and rear wall 18. When bottom rear frame member 19 is abutted against floor 12, brackets 500 extending rearwardly from rear wall 18, should abut, or nearly abut wall studs 502. At this point, a level should be placed against the inner surface of rear wall 18, and positioning of rear wall 18 should be adjusted as required for proper vertical orientation. Any remaining spaces between wall studs 502 and brackets 500 should be filled with wooden shimmies or other wooden spacers. Screws (not shown) are then driven through bracket holes 506 and into studs 502 to secure rear wall 18 to studs 502. Preferably, brackets 500 include enough holes 506 to ensure alignment of holes and studs when rear wall 18 is properly positioned. Alternatively, brackets 500 may include adjustment means for horizontally adjusting the positioning of its holes 506.

When a sidewall 14 or 16 is installed, it must be interfitted with rear wall 18 before it is securely mounted to the studs of the wall space. The first step in attaching a sidewall 14 or 16 to rear wall 18 is interfitting a conduit feeder section 86 or 88 with a conduit corner section 82 or 84. Referring again to FIG. 16*a*, corner sections have stems 520 and 522 extending forwardly therefrom. Before a sidewall is attached, portions of the water line 74, control line 76, and electrical line 78 extend outwardly from stems 520. Sidewall 14 is attached to rear wall 18 by first interfitting sleeve 524 of conduit feeder section 86 with stem 520 of conduit corner section 82. As stem 520 and sleeve 524 are interfitted, the extending portions of the water, control, and electrical lines become visible from module 526 and are interfaced with the water, control, and electrical lines of feeder section 86 by well known methods. It is seen that module 526 is positioned to enable an installer to interface feeder and corner water, control, and electrical lines while standing in the frame's interior. Module 526 is covered with a plate (not shown) when line interfacing is complete.

After the conduit sections of rear wall 18 and sidewall 14 are interfitted, sidewall 14 is securely attached to rear wall in accordance with the detail of FIG. 16*b*. Generally, tabs 530 welded to sidewall corner frame member 22 are screwedly attached to frame 10. With the inner surface of bottom side frame member 27 firmly abutting floor 12, sidewall 14 is then leveled and securely attached to the wall studs by the same bracket means as described in connection with FIG. 16*d* (rear wall installation detail).

As has been discussed throughout, the panels intended for mounting on the frame are arranged to the needs and preferences of each user. The first panels to be mounted on the frame are tub panels. The particular arrangement of tub panels will not vary significantly within classifications of users. For example, all primary users having limited locomotive ability but who need no assistance in bathing will likely require a 2-position door and a single bathers seat. Similarly, all users needing assistance in bathing will likely require a three-position door, one bather's seat, and a caregiver's seat mountable on a door panel.

By contrast, the arrangement of non-tub panels on the frame is likely to vary greatly among users, even among those who fall into like user classifications. For example, despite the fact that all users having limited locomotive ability will generally require grab bar panels dispersed throughout the frame, the particular arrangement of those grab bar panels will vary depending on user preference. There are two alternative methods for determining the optimum arrangement of panels on the frame. In a first method, a prospective user sits or stands in a model bathing unit located at a distributor's place of business. The prospective user is asked a variety of questions, several measurements are taken, and user reaction is recorded as manually removable dummy panels are temporarily installed in alternative locations on the frame. From the information collected, a scheme of panel installation is formulated away from the location of installation. In an alternative method for determining the optimum panel arrangement, essentially the same information is collected except that the information is collected at the location of installation. In the second method, the unpanelled installed frame serves the purposes of the model bathing unit of the first method. The first method is preferred since it likely enables the prospective user to explore more options and guarantees that all required panels will be ordered and on site at the time of installation. The second method will be used where a prospective user does not have access to a model unit.

Tub panels may be installed on frame 10 using conventional methods for installing bathtub fixtures in a bathing unit. That is, interfaces between panels and frame 10, or among panels may be sealed using the traditional sealing and fixing agents such as cement, caulk, or grout. Preferably, however, tub panels (and above-tub panels) are installed with minimal use of sealing agents to simplify future modifications of the unit.

Figure 16F:
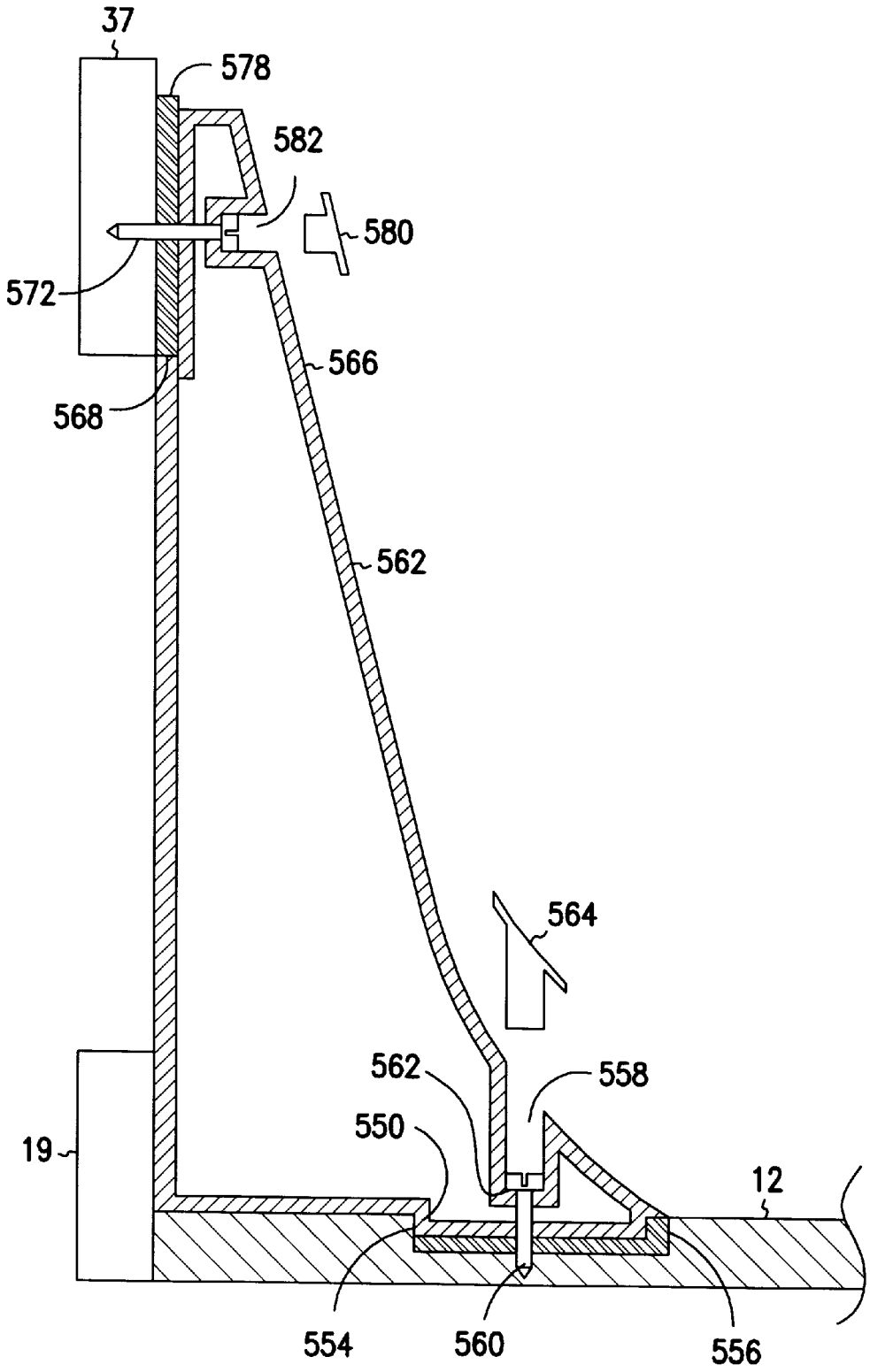
FIG. 16*f* is a cross-sectional view according to section line K—K of FIG. 11*a*.
Figure 16G:
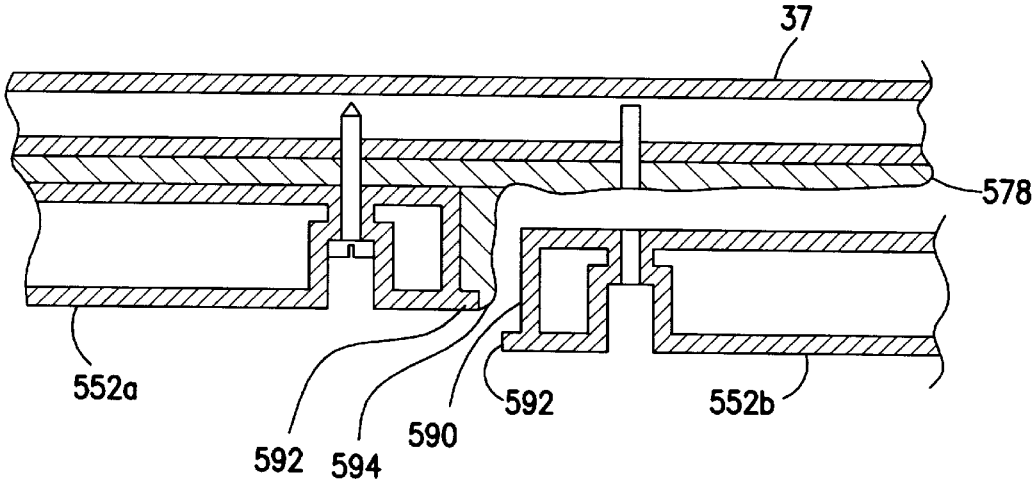
FIG. 16*g* is a cross-sectional view according to section line J—J of FIG. 11*a*.

FIGS. 16*f* and 16*g* illustrate a preferred means of installing bathtub panels with minimal or no use of pasty or gelatin sealing agents. Referring to FIG. 16*f*, it is seen that floor 12 is not perfectly flat, but instead has a depression 550 defining the installation location of representative tub panel 552. Tub panel 552 has a protrusion which is fittible into depression 550. Interposed between floor depression 550 and protrusion 554 is an L-gasket 556. When inserted into cavity 558, and driven through aligned holes of the tub panel, the L-gasket, and the floor, screw 560 compresses gasket 556 to form a seal between panel 552 and floor 12. Seal washer 562 prevents moisture from intruding through said aligned holes. Finally, an aesthetic capper 564, which minimizes the amount of moisture that intrudes into cavity 558, is inserted into cavity 558.

Tub panel top 566, meanwhile, is sealed to rear tub-level frame member 37. Top 566 has a ridge 568 in which a straight gasket 578 rests. When screw 572 is driven through aligned holes of panel 552, straight gasket 578, and frame member 37, gasket 578 is compressed and a seal is formed between tub panel top 566 and tub-level frame member 37. Top capper 580 is then inserted into upper cavity 582.

FIG. 16*g* illustrates a means for providing a seal between two adjoining tub panels. Shown in FIG. 16*g* are an installed tub panel 552*a*, and adjoining tub panel 552*b*. Edges 590 of each panel are tapered as shown such that the panels have decreasing widths from front to back. Furthermore, panel edges 590 contain front lips 592, as shown. Middle gasket 594, shown in its natural configuration, is placed between the tub panels. As adjoining tub panel 552*b* is installed, its lip 592 will catch extruding portion of middle gasket 594 and constrain the gasket to the area defined by panel edges 590 and straight gasket 578. Its expansion constrained to this area, middle gasket 594 will exert pressure on each panel edge 590 and straight gasket 578 to form a seal between adjoining tub panels 552*a* and 594*b*.

Figure 16H:
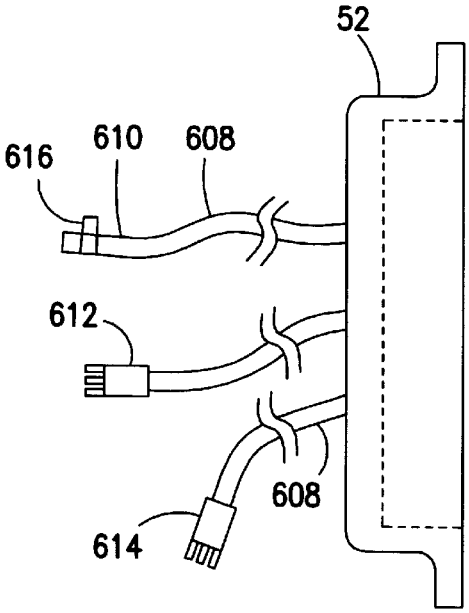
FIG. 16*h* is a side view of bathing equipment panel having pig tails extending rearwardly therefrom.

A means for sealing above-tub bathing equipment panels has been described previously in connection with FIG. 2*a*. However, before they are mounted to frame 10, above-tub panels must first be interfaced with conduit 72. With reference now to FIG. 16*h*, it is seen that above-tub bathing equipment panels 52 have up to three pig tails 608 extending rearwardly therefrom. Specifically, a panel requiring water typically will have a flexible hose 610 extending therefrom and terminating in means for connecting with pipe outlets of the conduit. Meanwhile, a panel requiring control will have a sheath housing a plurality of control wires terminating in a male control plug 612 for interfacing with female control line plug 116 of conduit 72. Finally, a panel requiring electricity typically will have a sheath housing electrical wires terminating in a three-pronged plug 614. Control and electrical pig tails are simply plugged into access nodes 110 of conduit 72. Hose 610 of a water line pigtail, meanwhile, is slid over an access water pipe 112 of an access node, then clamped, typically with a conventional hose clamp 616.

Illustrative Methods of Use

It has been highlighted in the foregoing discussion that a primary feature of the present invention is that it is customizable to meet the preferences of individuals whether or not they fall into a specialized classification of users.

Without detracting emphasis from the fact that the bathing unit is universal in the sense that it may be adapted to the preferences of all users of all ages and all levels of locomotive ability, another primary feature of the invention is that it may be configured such that the unit satisfies common requirements of bathers who fall into certain specialized classifications.

Figure 17:
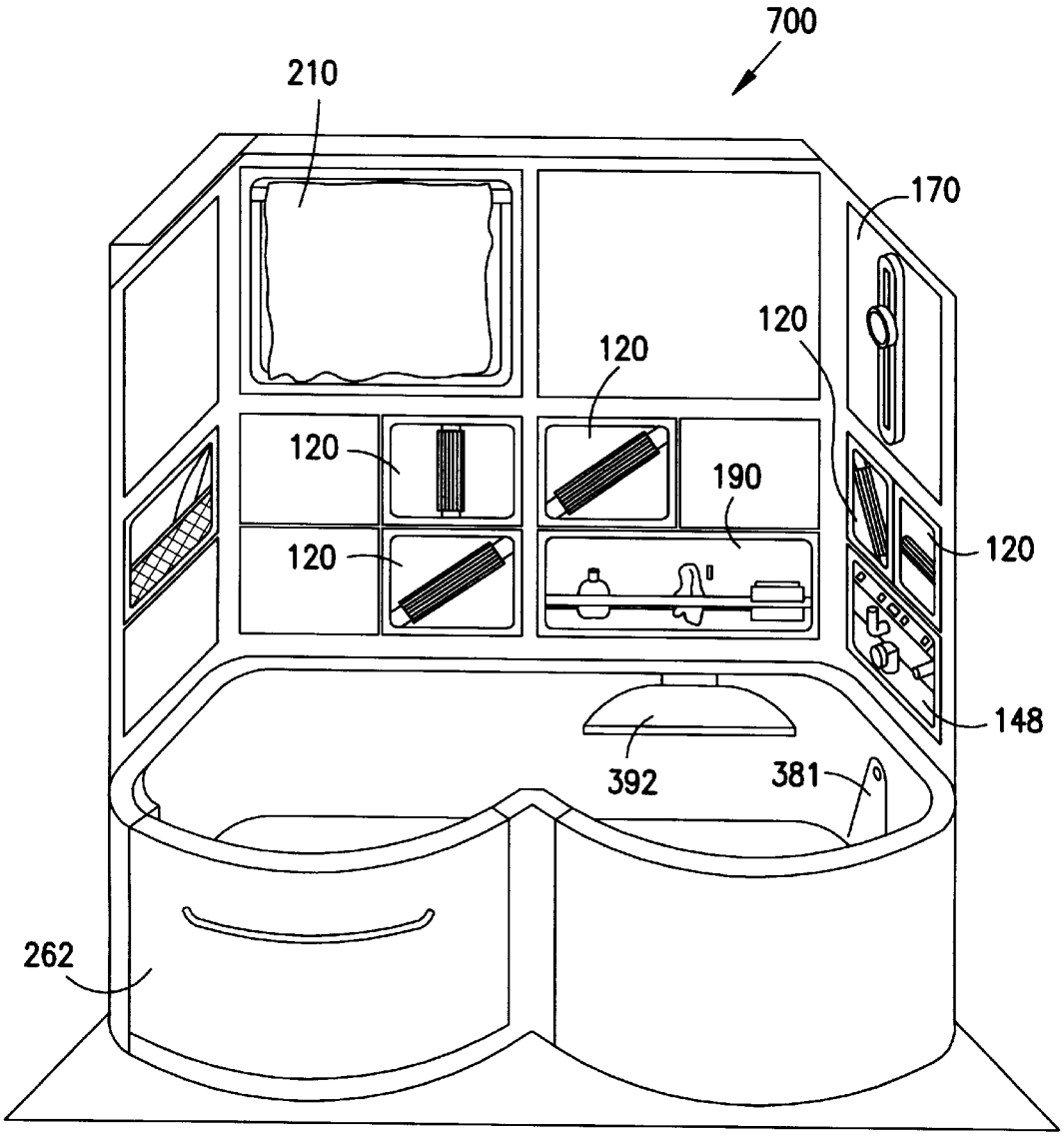
FIG. 17 is a perspective view of a representative embodiment of the invention.
Figure 19:
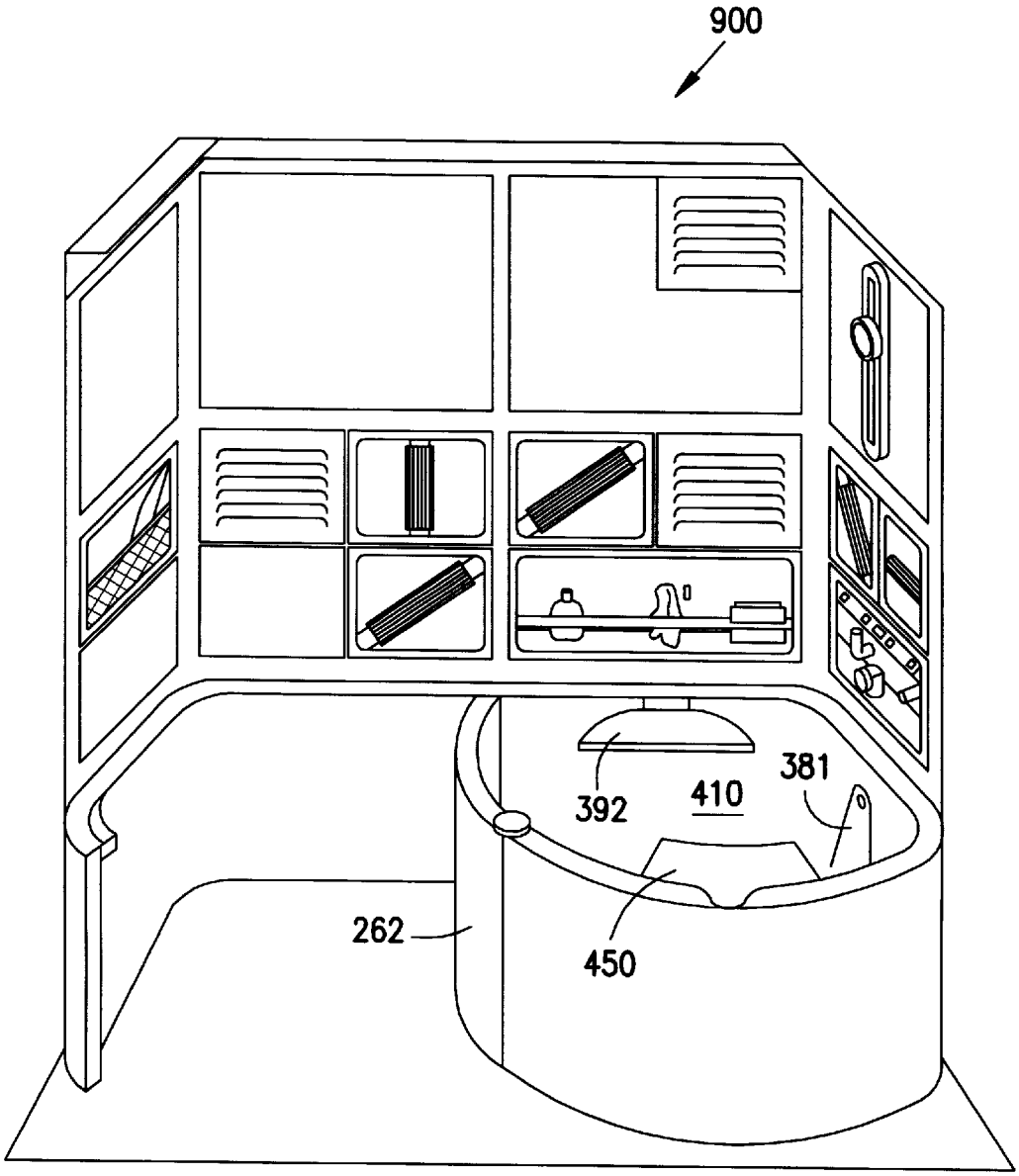
FIG. 19 is a perspective view of a representative embodiment of the invention.

Referring now to FIGS. 17 to 19, illustrative embodiments of the invention will be described. The description will include discussion of the specialized features of those embodiments as they relate to the requirements of the classifications of users which those embodiments are intended to serve.

FIG. 17 shows an embodiment of the invention intended for use by persons having limited locomotive ability. The embodiment 700 has a paneled tub design with a two-position door 262 pivotable between an open position and a closed position defining a full-size bathtub. One of the tub panels has mounted thereon a tub seat 392, which may be mounted on a lift panel 410 for lowering the seat. If seat 392 is mounted on a lift panel 410, the lift may be operated by activating the appropriate controls on control and display panel 148. Control and display panel 148 should be affixed to frame 10 as shown such that it is within arms reach of a user seated on the seat. Grab bar panels 120 are generally received in panels throughout the lower portion of the above-tub region for improving the balance and mobility of a user. While the grab bar panels 120 improve the balance and mobility of a user, the possibility always exists that the user will fall. Because the features of the panels are generally recessed, the potential for serious injury resulting such falling is minimized.

Another classification of users who would derive benefit from a specialized bathing unit configuration is the classification of aged persons. In designing a representative embodiment of the invention for use by aged persons, the inventor found that many aged persons: (1) suffer from limited locomotive ability, (2) experience heightened discomfort in cold or drafty environments, (3) experience difficulty in breathing in humid bathing environments, (4) have decreased vision, especially when uncorrected, and (5) experience a heightened sense of discomfort and emotional stress when naked.

FIG. 18 shows an illustrative embodiment of the invention intended for use by aged persons 800. Because aged persons commonly suffer from a loss of locomotive ability, the embodiment includes many of the same features as the embodiment described above. These common features include a two-position door, a bather's seat 416 mounted on a lift panel 410, a control panel 148 within arm's reach of the user, and plurality of grab bar panels 120 disposed within the lower region of the frame.

In addition to these features, the embodiment includes features specifically for the benefit of aged persons. As mentioned, aged persons have reported discomfort upon exposure to cold or drafty air. This sensitivity is increased in a bathtub environment where the bather is unclothed and the air temperature significantly contrasts that of the water. Accordingly, an embodiment of the invention intended for use by aged persons typically will have a pair of heater panels 224 mounted on opposite ends of the frame for warming the temperature of the air surrounding the tub.

Because aged persons often experience difficulty in breathing in misty and humid environments, the embodiment further has ventilation panels 228 installed in the upper portion of the above-tub panels for carrying mist and fog away from the bathing area.

Lighting considerations are particularly important in designing embodiments of the invention for use by the aged. While researching the bathing needs of aged persons, the inventor found that one of the most frequently complained-of problems with the conventional bathtubs is that they are poorly lit. Persons with poor vision have difficulty in seeing equipment mounted on and articles stored in standard bathing units. The usual action taken in response to the lighting problem is to install high-wattage light bulbs in the ceiling above the tub. This "solution" to the problem, however, has been observed to have a deleterious side-effect. Aged persons have reported that excessive overhead lighting creates emotional stress and discomfort as it makes them feel "more naked." Thus, it is important that embodiments of the invention designed for use by the aged include panels having light fixtures disposed therein for providing side lighting, as opposed to overhead lighting, to the bathing area. A bathing unit with lighting disposed on its panels provides sufficient illumination to equipment and articles of the unit, but does not provide so much light to the user's body that it engenders such feelings of nakedness.

The third classification of persons who would benefit from specialized bathing adaptations is the classification of persons who require assistance in bathing. Persons who require assistance in bathing will often also be persons who are aged and/or who suffer from limited locomotive ability.

Keeping in mind, then, that embodiments of the invention intended for use by persons requiring assistance will also include many of the features discussed above, FIG. 19 depicts the specialized and often additional features of a bathing unit 900 intended for use by persons requiring assistance in bathing.

Prior art bathing units typically have no adaptations which take into account the needs of care-givers to persons who need that care. One problem that caregivers often face is a lack of access to the bather. The standard bathtub is in the shape of an elongated oval and the bather must sit in the tub facing in one direction, with one side of her body facing a wall and the other side facing the front of the tub. Thus a caregiver situated outside of the tub has great difficulty in reaching, for purposes of washing or otherwise, the side of the bather's body that faces the wall. Frontal access to a bather in a standard tub is also difficult. Often a caregiver must wash or provide support to the front of a bather's body with only one hand, and place the other hand on the edge of a bathtub for support and balance.

With reference now to FIG. 19, an embodiment of the invention intended for use by bathers requiring assistance 900 will be described in detail. As shown, the embodiment includes a four-position door, as described previously with reference to FIGS. 9*a*–10*b*. Collapsible into a configuration that defines a half-size bathtub, the four-position door facilitates improved access by a caregiver to a bather. Engaging door 262 with second opening 278 changes the shape and size of the tub and thereby enables a caregiver situated outside of the tub to easily reach a bather from the front, left side or right side of the bather without excessive stretching and without employing a hand for balancing.

Further included in the embodiment is a bathers seat panel, as described in connection with FIGS. 13 through 14*g*. The bather seat may be fixed, collapsible, or may be mounted on a lift panel 410. A tub panel having a seat may be mounted on any rear or side panel. However, most preferably in a four-position tub embodiment, a bather seat is mounted on a rear panel such that a caregiver has optimum access to a bather situated in a collapsed half-size bathtub.

The embodiment may further include an additional seat 450, primarily for use by a caregiver, as described in connection with FIG. 15. It has been mentioned that the half-size bathtub significantly improves access to a bather by a caregiver situated outside of a tub. Nevertheless, it is anticipated that under some circumstances a caregiver my wish to enter the inside of the tub, and assume a seated position, for further improved access to a bather.

Figure 20:
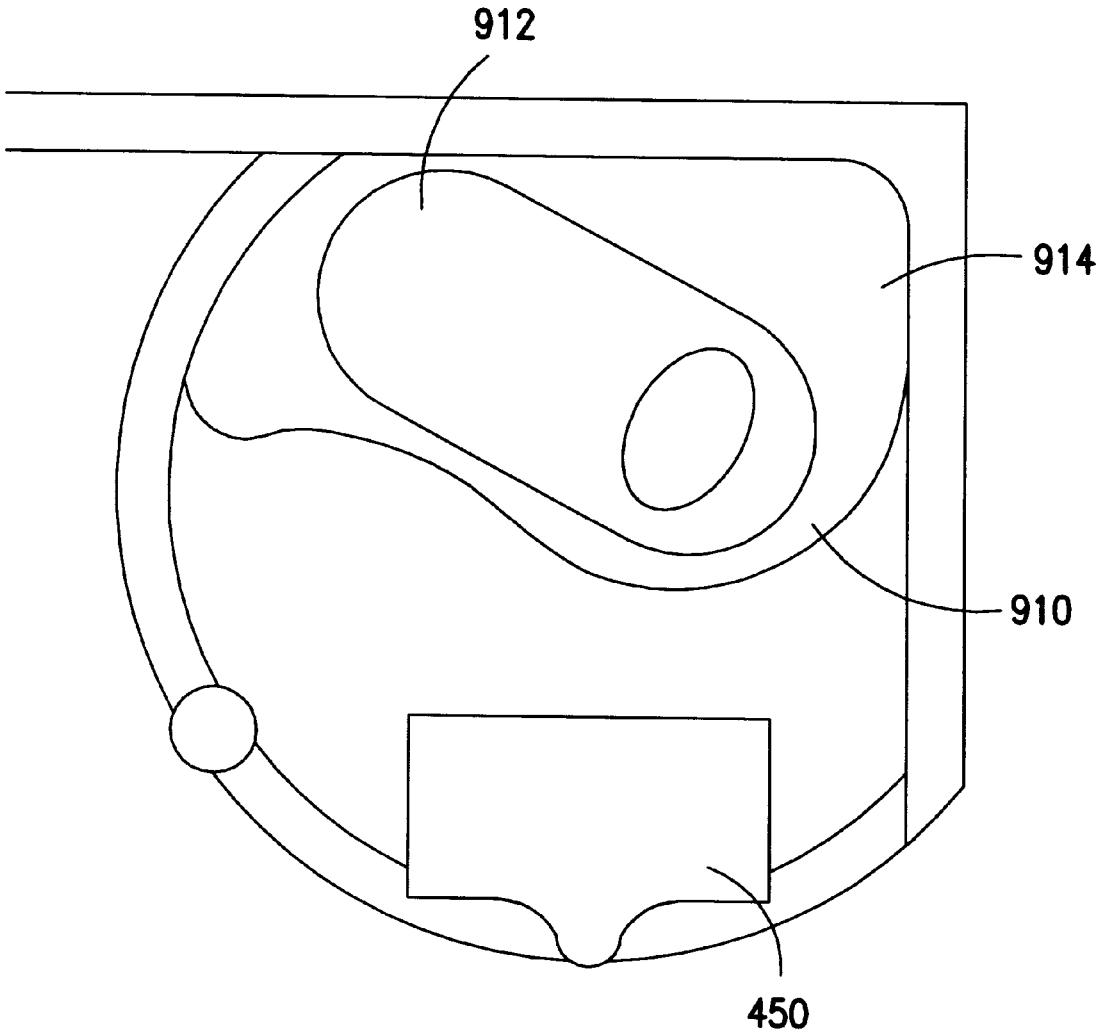
FIG. 20 is a top view of four-position bathtub having an infant tray installed therein.

Shown in FIG. 20 is a specialized adaptation of the bathing unit. Infant tray 910 may be installed on mount 414 of a tub lift panel 410 as described in connection with FIGS. 14*a* and 14*b*, such that it can be raised and lowered, preferably by way of controls of control and display panel 148. Alternatively, infant tray 910 may be used independent of lift panel 910, and instead may be configured such that tray 910 rests on the top surfaces of adjoining tub panels. Infant tray 910 includes minitub 912, and a shelf 914 for holding bathing articles. In the embodiment shown, infant tray is installed on a tub lift panel of a four-position tub. The embodiment provides a caregiver, who may sit in caregiver seat 450, uninhibited access to an infant positioned in minitub 912.

While embodiments of the present invention have been described with a high degree of particularity, it is understood that an infinite number of variations and changes to the invention can be made without departing from the spirit thereof. Therefore, it is highlighted that the invention should be taken as limited only by the scope of the appended claims.

What is claimed is:

1. A bathing unit comprising:

a frame having a wall, an inner surface of said wall having a plurality of receptacles to receive removable and interchangeable modular bathing equipment panels;

wherein said bathing unit further comprises a plurality of said removable and interchangeable modular bathing equipment panels removably attached to said frame; and a bathtub comprising a plurality of said removable and interchangeable modular bathing equipment panels in a tub region of said frame.

2. The bathing unit of claim 1 wherein:

said frame has mounted thereon a water line to provide water to locations on said frame easily accessed by said removable and interchangeable modular bathing equipment panels.

3. The bathing unit of claim 1 wherein:

said frame has mounted thereon an electrical line to provide electrical power to locations on said frame easily accessed by said removable and interchangeable modular bathing equipment panels.

4. The bathing unit of claim 1 wherein:

said frame has mounted thereon a water line to provide water to locations on said frame easily accessed by said removable and interchangeable modular bathing equipment panels;

said frame has mounted thereon an electrical line to provide electrical power to locations on said frame easily accessed by said removable and interchangeable modular bathing equipment panels;

said frame further has mounted thereon a control line to transport control signals to and from said removable and interchangeable modular bathing equipment panels.

5. A bathing unit comprising a frame, said frame comprising:

a rear wall;

a pair of sidewalls attached to and extending forwardly from said rear wall;

a plurality of receptacles to receive removable and interchangeable modular bathing equipment panels, said receptacles being disposed in said walls;

wherein said bathing unit further comprises a plurality of said removable and interchangeable modular bathing equipment panels removably attached to said frame; and a bathtub comprising a plurality of said removable and interchangeable modular bathing equipment panels in a tub region of said frame.

6. The bathing unit of claim 5, further comprising:

a water line mounted on said frame to provide water to locations on said frame easily accessed by said removable and interchangeable modular bathing equipment panels.

7. The bathing unit of claim 5, further comprising:

an electrical line mounted on said frame to provide electrical power to locations on said frame easily accessed by said removable and interchangeable modular bathing equipment panels.

8. The bathing unit of claim 5, further comprising:

a water line mounted on said frame to provide water to locations on said frame easily accessed by said removable and interchangeable modular bathing equipment panels;

an electrical line mounted on said frame to provide electrical power to locations on said frame easily accessed by said removable and interchangeable modular bathing equipment panels;

a control line mounted on said frame to transport control signals to and from said removable and interchangeable modular bathing equipment panels.

9. The bathing unit of claim 8, further comprising:

a conduit mounted on said frame to house said water line, said control line, and said electrical line.

10. The bathing unit of claim 5, wherein said walls comprise intersecting frame members to define said receptacles.

11. The bathing unit of claim 10, further comprising lattice members receivable within said receptacles to define smaller-sized receptacles, whereby said frame may receive said equipment panels.

12. The bathing unit of claim 10, further comprising:

a water line means mounted on said frame;

an electrical line means mounted on said frame.

13. The bathing unit of claim 10, further comprising:

a grab bar panel installed in one of said receptacles;

wherein said grab bar panel is one of said removable and interchangeable modular bathing equipment panels.

14. The bathing unit of claim 12, wherein said frame members define an above-tub region above said tub region, said above-tub region having an upper portion and a lower portion.

15. The bathing unit of claim 14, further comprising:

a two-position door panel in said bathtub in said tub region.

16. The bathing unit of claim 15, further comprising:

a grab bar panel installed in said above-tub region.

17. The bathing unit of claim 15, further comprising:

a bather seat installed on said bathtub.

18. The bathing unit of claim 15, further comprising:

a grab bar panel installed in said above-tub region;

a bather seat installed on said bathtub;

a storage rack panel installed in said above-tub region;

a shower panel installed in said above-tub region.

19. The bathing unit of claim 15, further comprising:

a grab bar panel installed in said above-tub region;

a bather seat installed on said bathtub;

a control panel installed in said above-tub region;

a storage rack panel installed in said above-tub region;

a shower panel installed in said above-tub region;

a heater panel installed in said above-tub region;

a ventilation panel installed in said above-tub region;

a plurality of lights disposed in said equipment panels for providing side-lighting to said unit's interior.

20. The bathing unit of claim 14, further comprising:

a four-position door panel in said bathtub in said tub region.

21. The bathing unit of claim 20, further comprising:

a bather seat installed on said bathtub.

22. The bathing unit of claim 20, further comprising:

a grab bar panel installed in said above-tub region.

23. The bathing unit of claim 20, further comprising:

a grab bar panel installed in said above-tub region;

a bather seat installed on said bathtub;

a storage rack panel installed in said above-tub region;

a shower panel installed in said above-tub region.

24. The bathing unit of claim 20, further comprising:

a grab bar panel installed in said above-tub region;

a bather seat installed on said bathtub;

a control panel installed in said above-tub region;

a storage rack panel installed in said above-tub region;

a shower panel installed in said above-tub region;

a heater panel installed in said above-tub region;

a ventilation panel installed in said above-tub region;

a plurality of lights disposed in said equipment panels for providing side-lighting to said unit's interior.

25. The bathing unit of claim 14, further comprising:

an infant tray installed in said bathtub.

26. The bathing unit of claim 13, wherein said grab bar panel comprises:

a bar having two ends;

a body having a bar receptacle disposed thereon;

wherein said bar receptacle comprises a plurality of oppositely arranged receiving points for receiving said bar ends;

whereby said bar may be positioned in a plurality of distinct orientations.

27. The bathing unit of claim 26, wherein said bar comprises:

a housing;

pins extending outwardly from said housing to form said ends;

spring disposed in said housing to bias said pins outwardly such that said bar extends to a range of different lengths.

28. The bathing unit of claim 26, wherein said body comprises:

a recess having a sidewall defining the periphery of said recess;

wherein said bar receptacle comprises a track formed in said sidewall.

29. The bathing unit of claim 26, wherein said body comprises:

a recess having a sidewall defining the periphery of said recess;

wherein said bar receptacle comprises a plurality of holes formed in said sidewall.

30. The bathing unit of claim 20, wherein said bathtub further comprises:

a rear wall panel;

a pair of sidewall panels extending from said rear wall panel;

a center hinge;

a front wall panel extending from one of said sidewall panels and terminating at said center hinge;

a first opening delimited by said center hinge and a sidewall panel;

a second opening delimited by said center hinge and said rear wall panel;

wherein said door panel is mounted on said center hinge pivotable between a first open position wherein said door extends to a position outside of said tub; a first closed position closing said first opening and defining a full-size bathtub; a second open position wherein said door extends to a position inside said tub; and a second closed position closing said second opening and defining a smaller-size bathtub.

31. The bathing unit of claim 30, wherein each of said openings comprises an elongated recess to receive said door.

32. The bathing unit of claim 30, wherein said center hinge comprises:

a first elongated notch vertically formed on the outer surface of said center hinge to receive said door in said first closed position;

a second elongated notch vertically formed on the outer surface of said center hinge to receive said door in said second closed position.

33. The bathing unit of claim 32, wherein said center hinge further comprises:

a sloping outer surface;

door panel lifting means;

whereby said door is engaged and disengaged with each of said notches by vertical motion.

34. The bathing unit of claim 20, wherein a top surface of one of said removable and interchangeable modular bathing equipment panels has a hole formed therein;

wherein said bathing unit further comprises a seat having a stem extending downwardly therefrom, said stem being received in said hole; and wherein said seat is pivotable.

35. The bathing unit of claim 1 wherein:

said frame has mounted thereon control to transport control signals to and from said removable and interchangeable modular bathing equipment panels.

36. The bathing unit of claim 5, further comprising:

a control line mounted on said frame to transport control signals to and from said interchangeable modular bathing equipment panels.

37. The bathing unit of claim 10, further comprising:

control line mounted on said frame.

38. The bathing unit of claim 15, further comprising:

a tub lift panel installed in said tub region;

wherein said tub lift panel is comprised of lifting means and a mount fixedly attached to said lifting means;

whereby an object may be removably attached to said mount such that said object may be positioned in a plurality of locations along a substantially vertical line in said tub region.

* * * * *

UNITED STATES PATENT AND TRADEMARK OFFICE

CERTIFICATE OF CORRECTION

PATENT NO. : 6,076,204

DATED : June 20, 2000

INVENTOR(S) : Mullick

It is certified that error appears in the above-identified patent and that said Letters Patent is hereby corrected as shown below:

In column 4, line 25 delete "mountable on the frame".

In column 4, line 44 insert -- the -- before "center".

In column 9, line 48 after "Specifically," and before "a water heater" insert --first control 152 adjusts the intensity of --.

In column 15, line 45 delete "Barrel" and insert --Barrett--, therefor.

In column 18, line 62 insert --have-- after "82".

In column 25, lines 19 and 20 delete "means"; both occurrences.

In column 26, line 29 insert -- a -- before "spring".

In column 28, line 2 insert -- a -- after "thereon" and insert -- line-- after "control".

In column 28, line 11 insert -- a -- before "control".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*